US008820893B2

(12) United States Patent
Mou et al.

(10) Patent No.: US 8,820,893 B2
(45) Date of Patent: Sep. 2, 2014

(54) INKJET PRINTHEAD

(75) Inventors: Hao Jan Mou, Hsin-Chu (TW); Ta Wei Hsueh, Hsin-Chu (TW); Ying Lun Chang, Hsin-Chu (TW); Rong Ho Yu, Hsin-Chu (TW); Hsien Chung Tai, Hsin-Chu (TW); Cheng Ming Chang, Hsin-Chu (TW); Wen Hsiung Liao, Hsin-Chu (TW); Yung Lung Han, Hsin-Chu (TW)

(73) Assignee: Microjet Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 13/340,372

(22) Filed: Dec. 29, 2011

(65) Prior Publication Data

US 2012/0242752 A1 Sep. 27, 2012

(30) Foreign Application Priority Data

Mar. 23, 2011 (CN) ..... 2011 1 0080631

(51) Int. Cl.

| | |
|---|---|
| ***B41J 2/14*** | (2006.01) |
| ***B41J 2/16*** | (2006.01) |
| ***B41J 2/05*** | (2006.01) |
| ***B41J 2/045*** | (2006.01) |

(52) U.S. Cl.

CPC ..... *B41J 2/0458* (2013.01); *B41J 2/04541* (2013.01); *B41J 2/04543* (2013.01); *B41J 2/14072* (2013.01)

USPC ..... 347/59; 347/50; 347/57; 347/58

(58) Field of Classification Search

USPC ..... 347/42

See application file for complete search history.

(56) References Cited

U.S. PATENT DOCUMENTS

| | | | | |
|---|---|---|---|---|
| 5,696,544 | A * | 12/1997 | Komuro | 347/50 |
| 6,422,676 | B1 * | 7/2002 | Torgerson et al. | 347/13 |
| 6,585,352 | B1 * | 7/2003 | Torgerson et al. | 347/40 |
| 6,789,871 | B2 * | 9/2004 | Edelen et al. | 347/19 |
| 6,866,364 | B2 * | 3/2005 | Torgerson et al. | 347/40 |
| 7,195,341 | B2 * | 3/2007 | King et al. | 347/57 |
| 7,344,227 | B2 * | 3/2008 | King et al. | 347/57 |
| 2004/0201639 | A1 | 10/2004 | Hayasaki | |
| 2005/0140710 | A1 | 6/2005 | Ou et al. | |

FOREIGN PATENT DOCUMENTS

| | | | |
|---|---|---|---|
| TW | 1225009 | B | 12/2004 |
| TW | 1234517 | B | 6/2005 |
| TW | 1277525 | B | 4/2007 |
| TW | 200904646 | A | 2/2009 |
| WO | WO 2009/015406 | A1 | 2/2009 |

* cited by examiner

*Primary Examiner* — Stephen Meier
*Assistant Examiner* — Renee I Wilson
(74) *Attorney, Agent, or Firm* — Birch Stewart Kolasch & Birch, LLP

(57) ABSTRACT

The present invention related to an inkjet printhead, adaptive for an ink cartridge including one ink-supplying tank, the inkjet printhead includes: a nozzle plate having a plurality of nozzles; and an inkjet chip for controlling ink jetting and having a total area region having a length and a width, the total area region including: a non-wiring region for installing one single ink-supplying flow channels; and a wiring region for installing an internal circuit including a plurality inkjet unit assembly, each inkjet unit of the inkjet unit assembly including a heater installed correspondingly to the nozzle; wherein an area of the wiring region of the inkjet chip is or less than 82% of a total area of the inkjet chip.

10 Claims, 17 Drawing Sheets

INKJET PRINTHEAD

CROSS REFERENCE TO RELATED APPLICATION

This application claims the benefits of the China Patent Application Serial Number 201110080631.5, filed on Mar. 23, 2011, the subject matter of which is incorporated herein by reference.

BACKGROUND OF THE INVENTION

1. Field of the Invention

The present invention relates to an inkjet printhead and, more particularly, to an inkjet printhead adaptive for a single-color inkjet printing.

2. Description of Related Art

In the present technologies of inkjet printhead, the best and the most effective way for improving the printing resolution and printing speed is achieved by increasing the quantity of heating elements on a inkjet chip directly, i.e. by increasing the quantity of nozzles. Traditionally, the controlling of the conventional heating elements is achieved by controlling a corresponding heating element through a single control contact.

With reference to FIG. 1, a schematic view illustrating the conventional circuit structure for controlling a heating element for heating is shown. As illustrated in FIG. 1, a heating element 10 is connected in-between a driving control terminal 11 and a switch element 12, and receives a voltage signal P from the driving control terminal 11. The switching element 12 connects in-between a control terminal 13 and a ground terminal 14, wherein the control terminal 13 receives an address signal A for controlling the on-off of the switching element 12. The switching element 12 is turned on when the address signal A received by the control terminal 13 is relatively logically high. In the meantime, the voltage signal P provides an electrical energy to the heating element 10, and printing the ink flowing over the heating element 10 onto a printing carrier through corresponding nozzles (not shown in the figure). On the contrary, the switching element 12 is turned off when the address signal A received by the control terminal 13 is relatively logically low. In the meantime, the voltage signal P stops supplying electrical energy to the heating element 10, so that the heating element 10 stops heating process. Therefore, the ink-jetting cannot be achieved.

However, in the aforementioned method for controlling the heating of a heating element, the number of heating elements has to be increased if the printing resolution and printing speed is increased. The number of control terminals needs to be correspondingly increased as well to control each heating element respectively. For instance, 20 control terminals is required for matching 20 address signals A which control the heating of an inkjet printhead, this leads to an increase in size of the whole wiring region of an inkjet chip (not shown in the figure) and an increase of the practical area for disposing of the inkjet chip. Moreover, the cost for manufacturing increases accordingly. The wiring region described above is the rest region except for ink-supplying flow channels.

Furthermore, in order to decrease the quantity of control terminals, a method for controlling the operation of heating element by N-MOS element is introduced correspondingly. However, the quantity of the corresponding control terminals should be increased if further increasing of the quantity of heating elements is desired. Therefore, methods for controlling by C-MOS are then introduced for solving the problem of the size-enlargement of the inkjet chip area that caused by the augmentation on wiring region when the quantity of control terminals increases. However, these methods still cannot be popularized since the cost for manufacturing C-MOS is much higher than that of N-MOS.

Therefore, a method capable of improving the shortcomings of inkjet printheads described above is quite in demand in this technical field.

SUMMARY OF THE INVENTION

An object of the present invention is to provide a inkjet printhead structure capable of controlling more inkjet elements with relatively less control contacts, to decrease the ratio occupied by the wiring region of a inkjet chip simultaneously, and to increase the printing resolution of a inkjet printhead via arranging heating elements interlacingly, so as to decrease the area of a inkjet chip greatly and shrink the size of the inkjet chip, and reducing the cost for disposing the inkjet chip as well.

To achieve the object, a general aspect of the present invention provides an inkjet printhead structure adapted for an ink cartridge that includes one ink-supplying tank, comprising:

- a nozzle plate having a plurality of nozzles; and
- an inkjet chip for controlling ink jetting and having a total area region having a length and a width, the total area region including:
  - a non-wiring region for installing one single ink-supplying flow channels; and
  - a wiring region for installing an internal circuit including a plurality inkjet unit assembly, each inkjet unit of the inkjet unit assembly including a heater installed correspondingly to the nozzle;
- wherein an area of the wiring region of the inkjet chip is or less than 82% of a total area of the inkjet chip.

To achieve the object, another general aspect of the present invention provides an inkjet printhead structure adapted for an ink cartridge that includes one ink-supplying tank, comprising:

- a nozzle plate having a plurality of nozzles; and
- an inkjet chip for controlling ink jetting and having a total area region having a length and a width, and the total area region including:
  - a non-wiring region for installing three ink-supplying flow channels; and
  - a wiring region for installing an internal circuit including a plurality inkjet unit assembly, each inkjet unit of the inkjet unit assembly including a heater installed correspondingly to the nozzle, each inkjet unit assembly comprising:
    - a first inkjet unit for receiving a voltage signal, a plurality of address signal and a selection signal; and
    - a second inkjet unit for receiving the voltage signal and the plurality of address signal;
- wherein the first inkjet unit makes the heater to act a heating performance when the selection signal is enabled in accordance with the voltage signal and the plurality of address signal, and the second inkjet unit makes the heater to act a heating performance when the selection signal is disabled in accordance with the voltage signal and the plurality of address signal, an area of the wiring region of the inkjet chip occupies under 82% of a total area of the inkjet chip.

DETAILED DESCRIPTION OF THE PREFERRED EMBODIMENT

Figure 1:
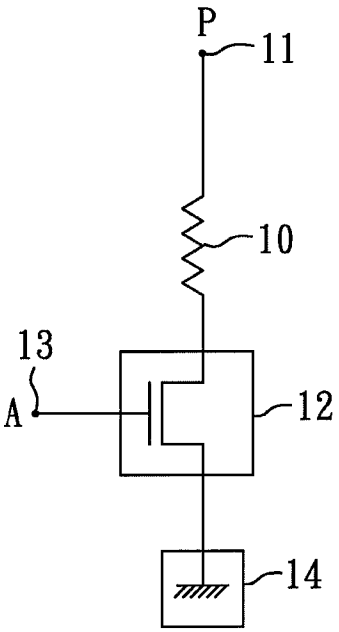
FIG. 1 (PRIOR ART)
FIG. 1 is a schematic view illustrating the conventional circuit structure for controlling a heating element for heating.

Other objects, advantages, and novel features of the invention will become more apparent from the following detailed description when taken in conjunction with the accompanying drawings. The description and the drawing in the specification of the present invention are essentially used for explanation only; they are not supposed to be used for limiting the scope of the present invention.

Figure 2A:
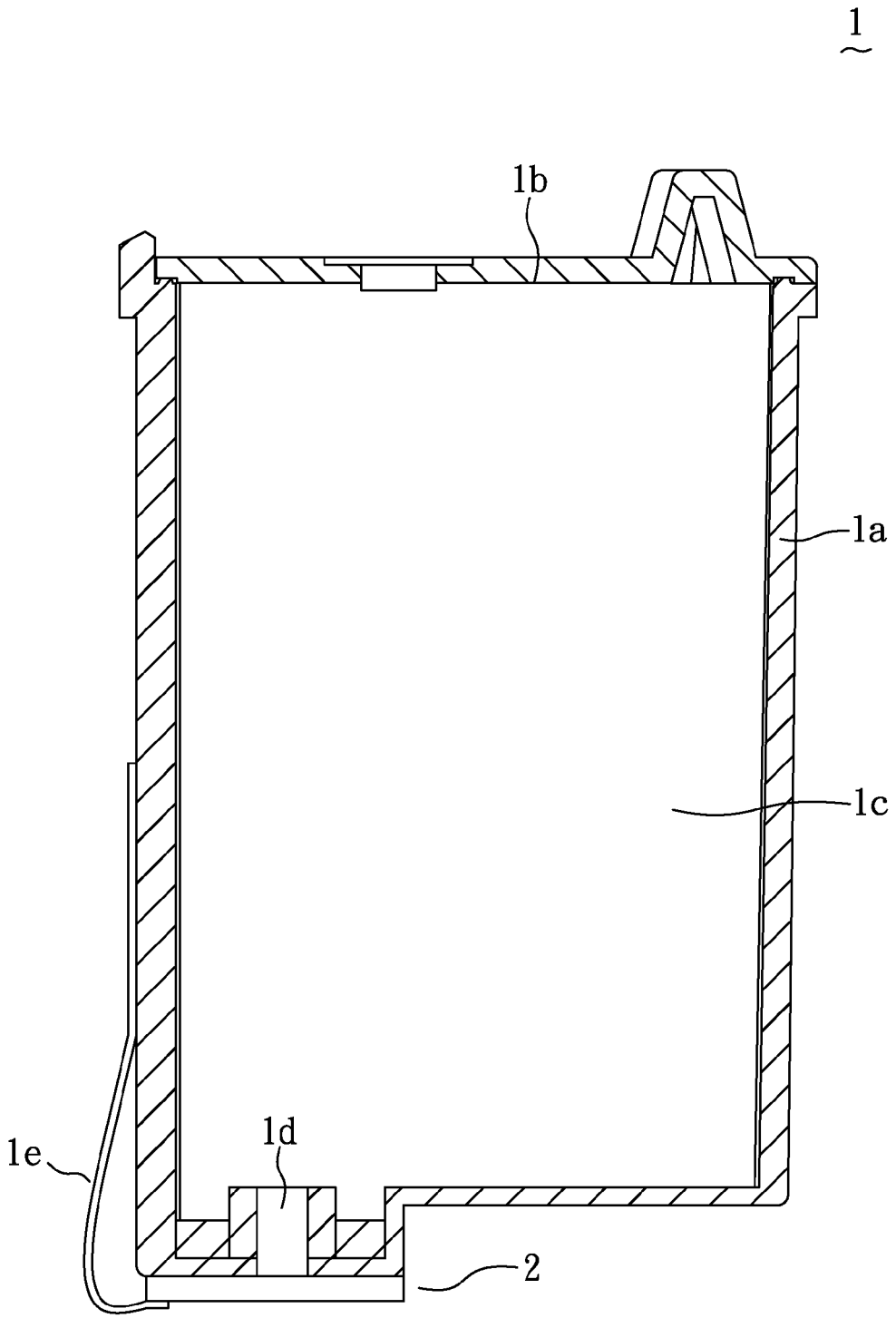
FIG. 2A is a schematic view illustrating the cross-sectional structure of an ink cartridge in accordance with a preferred embodiment of the present invention.

With reference to FIG. 2A, a schematic view for illustrating the cross-sectional structure of an ink cartridge in accordance with a preferred embodiment of the present invention is shown. As shown in FIG. 2A, an ink cartridge 1 is composed of a main body 1*a* and a cover body 1*b*, and at least one ink-supplying tank 1*c* is defined by the main body 1*a* and the cover body 1*b*. For example, one ink-supplying tank, two ink-supplying tanks, or three ink-supplying tanks is then defined for storing ink. The ink can be guided into an ink-supplying flow channel (not shown in the figure) of an inkjet printhead 2 by an ink-supplying flow channel 1*d* disposed on the main body 1*a*. The ink cartridge 1 further comprises a flexible circuit carrier board 1*e*, wherein one side thereof is connected with an electrical connection sheet (not shown in the figure) of the inkjet printhead 2. Moreover, plural metal contacts are disposed at the other side of the flexible circuit carrier board 1*e*, the flexible circuit carrier board 1*e* extends curvedly to attach a side of the main body 1*a* for connecting with the inkjet control circuit of an inkjet printer and the inkjet printhead. Additionally, the ink cartridge 1 receives the control signal of the inkjet control circuit of a system through the plural metal contacts of the flexible circuit carrier board 1*e* and commences to operate according to the control signal.

Figure 2B:
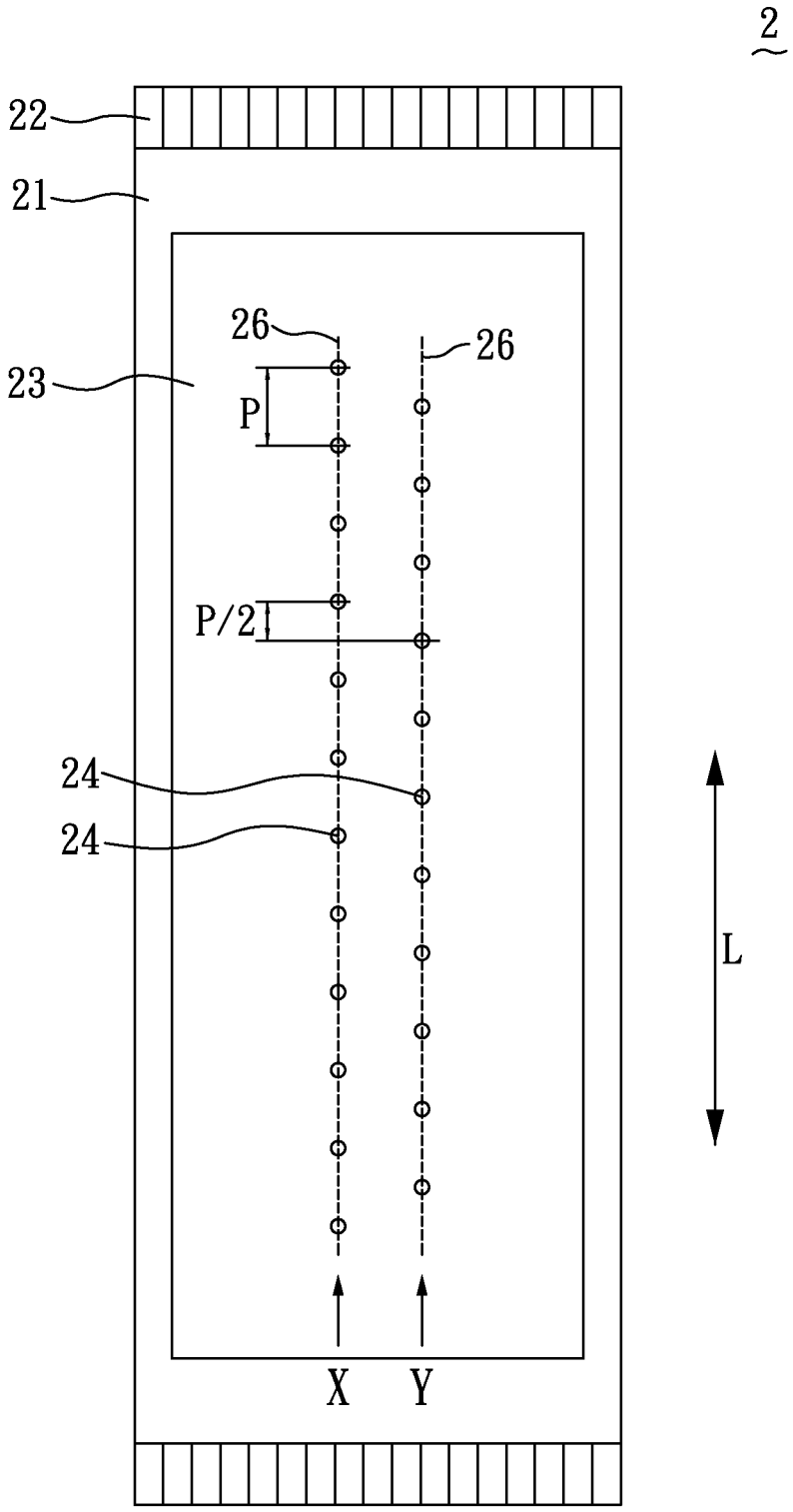
FIG. 2B is a schematic view illustrating the structure of a single-color inkjet printhead in accordance with a preferred embodiment of the present invention.
Figure 2C:
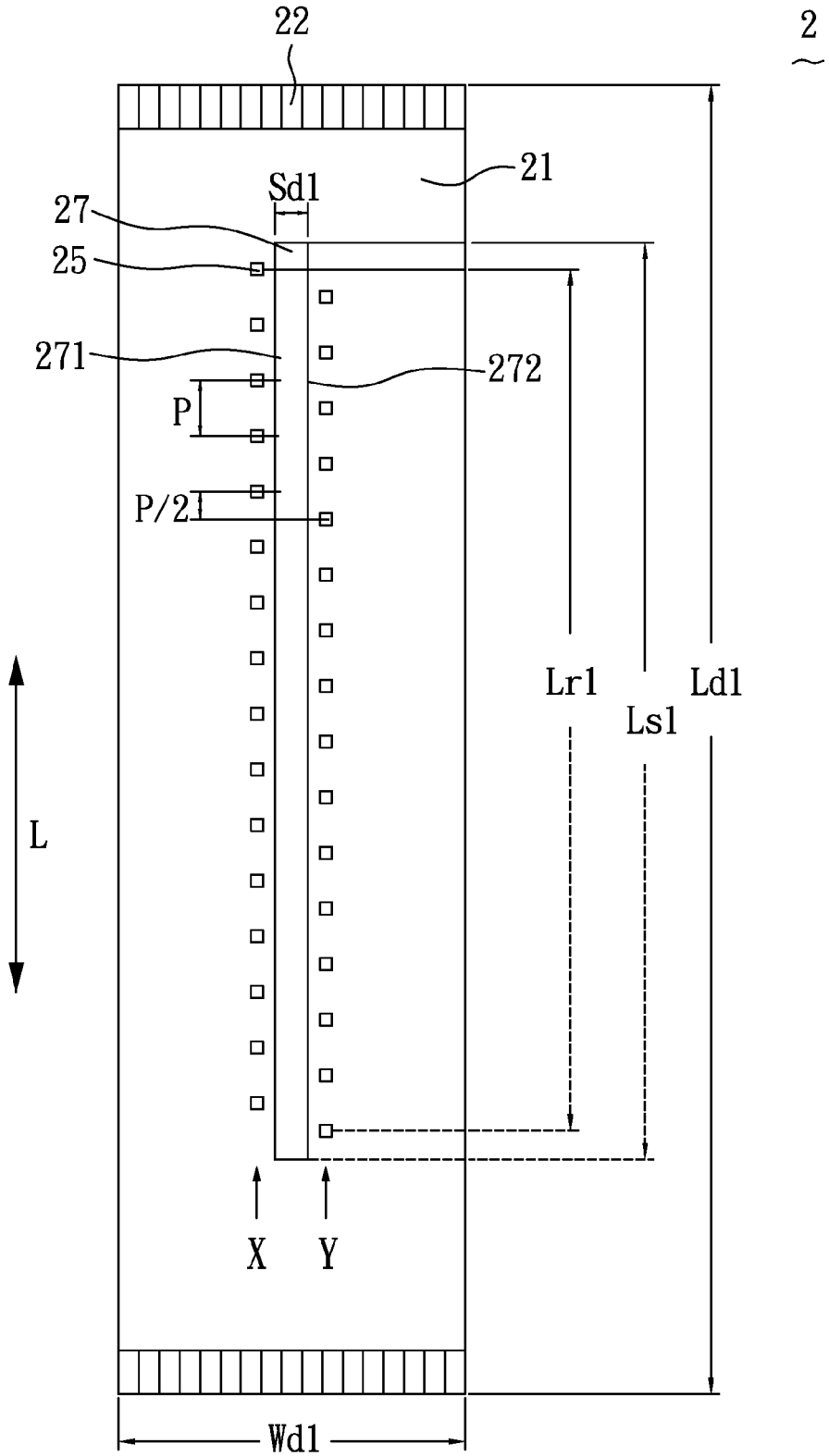
FIG. 2C is a schematic view illustrating the structure after the nozzle plate in FIG. 2B is removed.

With reference to FIG. 2B, a schematic view illustrating the structure of a single-color inkjet printhead in accordance with a preferred embodiment of the present invention is shown. The inkjet printhead 2 as illustrated in FIG. 2B is a simplified schematic view showing the structure. In the present embodiment, the inkjet printhead 2 is a strip-shape structure and includes an inkjet chip 21, an electrical connection sheet 22, and a nozzle plate 23. Moreover, the electrical connection sheet 22 is disposed on the inkjet chip 21, and a surface of the inkjet chip 21 has a plurality of heaters 25 (as shown in FIG. 2C) and, the nozzle plate 23 includes a plurality of nozzles 24 corresponding to the heaters. The number of the nozzles 24 can be, but not limited to, at least 750 in the present embodiment and the quantity of the heaters 25 is thus 750 correspondingly. Furthermore, in the present embodiment, the combined nozzle resolution of the inkjet printhead 2 can be 1200 dpi (dots per inch), which infers that the effective inkjet distance measured along with a reference axis L is $1/1200$ inch. In order to achieve the requirement of high resolution, the nozzles 24 on the inkjet printhead 2 can be arranged into an axis assembly comprising two row of axis, and the X-row axis and the Y-row axis of the two row of axis are represented as X and Y as shown in the figure. Additionally, each row of axis X and Y has a central line 26, the two central lines 26 are parallel with each other, and respectively parallel with reference axis L. Nozzles 24 of each row of axis X and Y are arranged interlacely with respect to nozzles of different axis X or Y. The distance between any two adjacent nozzles 24 on the same axis is defined as P, and the vertical distance between any two adjacent nozzles 24 on different axis is P/2. It is also noted that P is $1/600$ inch and P/2 is $1/1200$ inch.

FIG. 2C is a schematic view illustrating the structure after the nozzle plate in FIG. 2B is removed. As illustrated in the figure, the inkjet chip 21 of the inkjet printhead 2 in the present embodiment can be a rectangular structure where the length/width ratio thereof is preferable between 11 and 20. The length Ls1 of a central ink-supplying flow channel 27 and the total length Lr1 of the disposition of the heaters 25 vary according to the quantity of the heaters 25 and the resolution of the inkjet printhead 2 that the designer selects. In the present embodiment, the width Wd1 of the inkjet chip 21 is approximately 1.27~2.31 mm, and the length Ld1 thereof is approximately 25.4 mm, which leads the total area thereof to between 32.258~58.674 $mm^2$. Thereby, when the quantity of the nozzles of the inkjet printhead 2 in the present invention is 750, there are about 13 (750/58.674≈13)~23 (750/32.258≈) nozzles 24 per $mm^2$ on the nozzle plate 23. This implies the resolution (quantity of heaters/per $mm^2$) of the inkjet printhead 2 is between 13 and 23 heaters 25. Moreover, the heaters 25 disposed on the inkjet chip 21 eject the ink through the nozzles 24, which are arranged interlacingly. Additionally, there are 375 nozzles 24 in each row for disposing the heaters 25.

With reference to FIG. 2C once again, the surface of the inkjet chip 21 has a strip-shape central ink-supplying flow channel 27 and heaters 25, wherein the heaters 25 are respectively disposed at a single side or two sides of the central ink-supplying flow channel 27. In the present embodiment, the heaters 25 are disposed at the two sides of the central ink-supplying flow channel 27. Moreover, a side of the central ink-supplying flow channel 27 including a first longitudinal edge 271 where X rows of heaters 25 are arranged, and a second longitudinal edge 272 where Y rows of heaters 25 are arranged is at the other side of the central ink-supplying flow channel 27. In the present embodiment, the width Sd1 of the central ink-supplying flow channel 27 can be between 0.497 and 0.562 mm and, the length Ls1 can be 21.24 mm, wherein a wiring region of the inkjet chip 21 is exactly to subtract the area of the central ink-supplying flow channel 27 from the total area of the inkjet chip 21, which is the area that internal circuit can be disposed in.

Since the heaters 25 are disposed on the inkjet chip 21 with high density of inkjet printhead 2, therefore, the density of the heaters 25 on the inkjet printhead 2 should be higher than $10/mm^2$ to make the cost of the inkjet printhead 2 lower than that of the inkjet printhead 2 with fewer nozzles 24. In the present embodiment, 13~23 heaters 25 can be disposed within each square millimeter of the inkjet chip 21, which implies the quantity of the heaters 25 is approximately between 760 and 1350, and the quantity thereof is preferably one thousand. Accordingly, the density of the heaters 25 on the inkjet chip 21 is thereby approximately between 17 (1000/(25.4×2.31)≈17) and 31 (1000/(25.4×1.27)≈31).

According to the concept of the present invention, the ratio of the area capable of being wired of the inkjet chip 21 over the total are of the inkjet chip 21 can be calculated as the following formula:

((Total area of inkjet chip)−(unwired area of ink-supplying flow channel))/(total area of inkjet chip)

The ratio is exact to be ((length Ld1 of the inkjet chip 21*the width Wd1 of the inkjet chip 21)−(the length Ls1 of the ink-supplying flow channel 27*the width Sd1 of the ink-supplying flow channel 27))/(length Ld1 of the inkjet chip 21*the width Wd1 of the inkjet chip 21) in the present embodiment. Since the wiring region of the inkjet chip 21 is between 20.32 (25.4×1.27−0.497×21.24) $mm^2$ and 48.11 (25.4×2.31−0.562×21.24) $mm^2$, the ratio of the wiring region of the inkjet chip 21 over the total area of the inkjet chip 21 is between 63% (20.32 $mm^2$/32.258 $mm^2$) to 82% (48.11 $mm^2$/58.674 $mm^2$) accordingly. In the present embodiment, the optimal width Sd1 of the ink-supplying flow channel 27 is between 0.497 and 0.552 $mm^2$, and the optimal ratio of the wiring region of the inkjet chip 21 over the total area of the inkjet chip 21 is between 63% (20.32 $mm^2$/32.258 $mm^2$) and 82% (46.939 $mm^2$/58.674 $mm^2$).

Generally speaking, the heaters 25 needs to be operated under extremely high frequency for ink drops with light-weight to maintain high-speed printing. Moreover, high-speed printing with high resolution is provided from the inkjet printhead 2 of the present invention by combining high inkjet frequency and the heaters 25 arranged interlacingly in high density. The inkjet frequency that the heaters 25 of the inkjet printhead 2 of the present invention employed exceeds over 20 kHz, and the preferred frequency range is between 22 and 26 kHz. Furthermore, 24 kHz of operating frequency is employed in the present embodiment.

When the unwired area (which is the area of the ink-supplying flow channel 27) of the inkjet chip 21 is fixed, the area of the inkjet chip 21 can be reduced correspondingly if the area on the inkjet chip 21 for circuit disposition and the quantity of the contacts can be reduced (which is to reduce the wiring region). This allows for decreasing the size of the inkjet printhead correspondingly and hence reaching cost-effective on manufacturing the same. How to reduce the wiring region of the inkjet chip is then described as follow.

Figure 3:
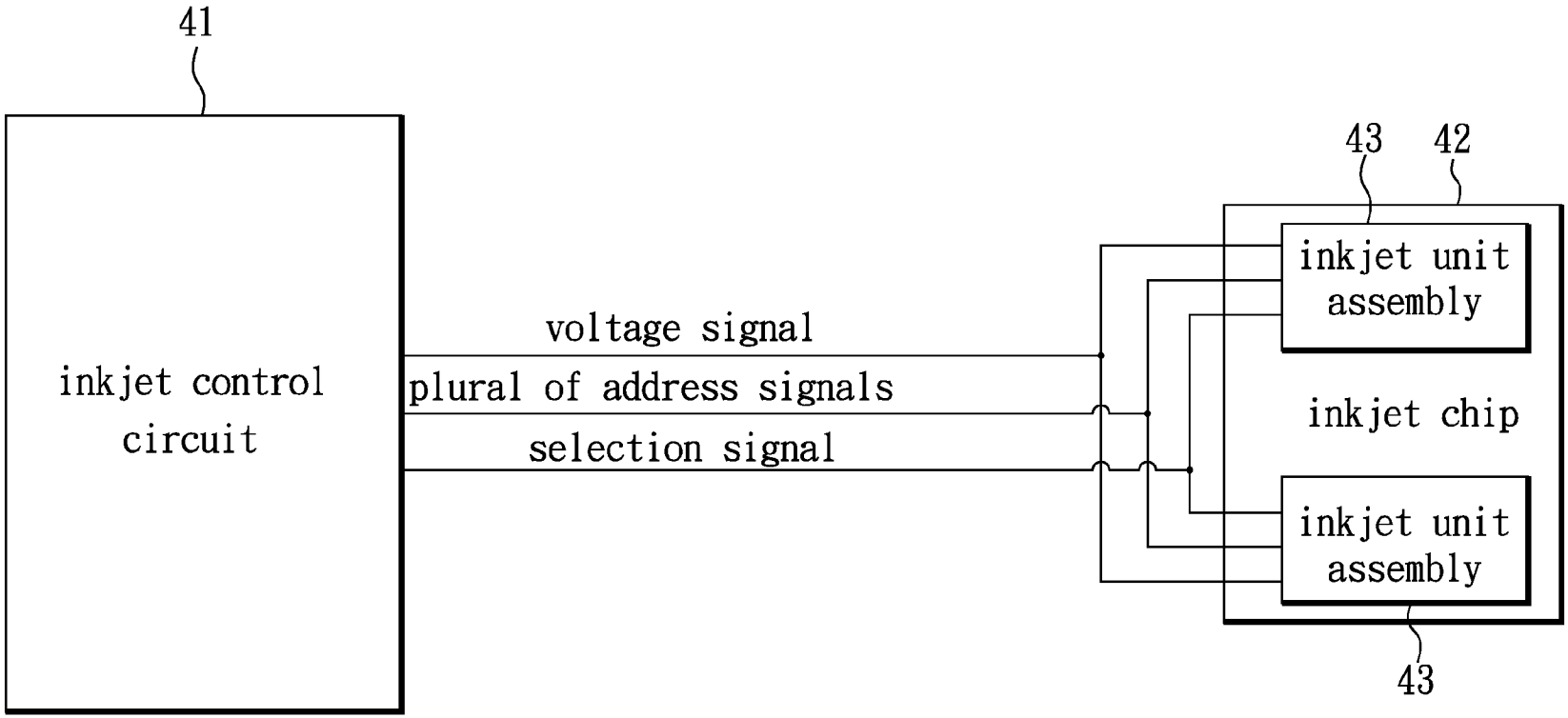
FIG. 3 is a schematic view illustrating the connection structure between the inkjet control circuit of an inkjet printer and the inkjet chip.

With reference to FIG. 3, FIG. 3 is a schematic view illustrating the connection structure between the inkjet control circuit of an inkjet printer and the inkjet chip. As shown in FIG. 3, the internal circuit (which is the inkjet control circuit) disposed on the wiring region of the inkjet chip 42 includes a plurality of inkjet unit assembly 43; each inkjet unit of the inkjet unit assembly 43 comprises a heater (not shown in the figure) disposed correspondingly to the nozzle. When under operation, plural voltage signals, plural address signals and plural selection signals are delivered from the inkjet control circuit 41 of the inkjet printer (not shown in the figure) to the plural inkjet unit assembly 43 of the inkjet chip 42 for controlling the operation of the entire inkjet printhead.

Figure 4:
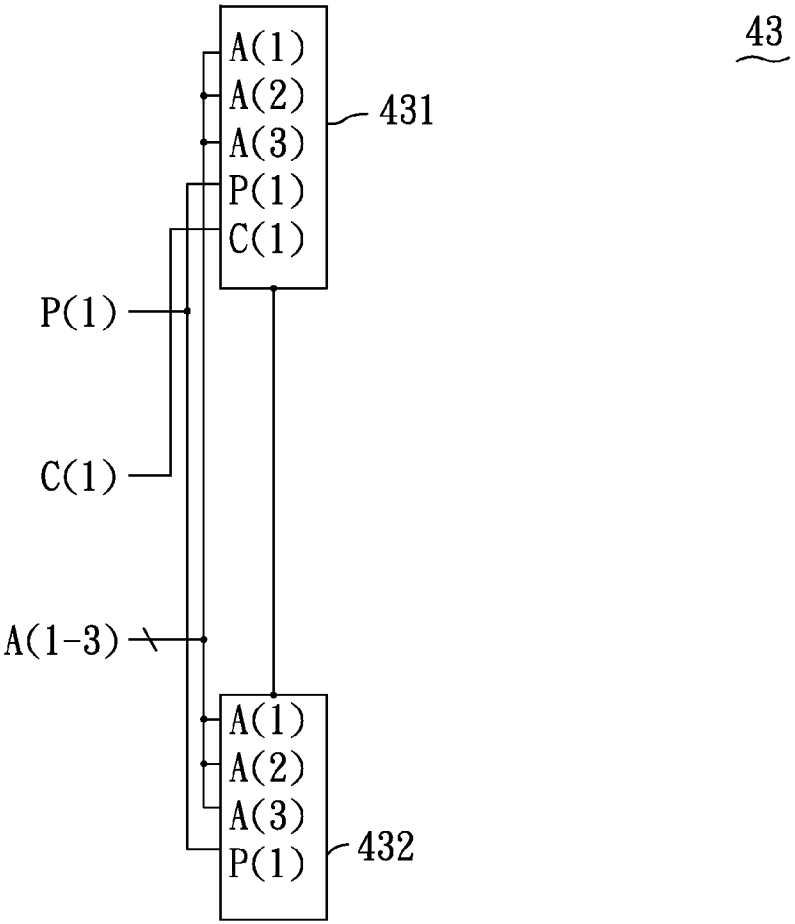
FIG. 4, which is a schematic view illustrating the circuit block of one of the inkjet unit assembly shown in FIG. 3.

With reference to FIG. 4, FIG. 4 is a schematic view illustrating the circuit block of one of the inkjet unit assembly as shown in FIG. 3. As shown in FIG. 4, the inkjet unit assembly 43 of the present invention comprises at least a first inkjet unit 431 and a second inkjet unit 432, wherein the first inkjet unit 431 is for receiving a voltage signal P(1), plural address signals A(n−1),A(n) and A(n+1), and a selection signal C(1). For example, when n=2, the address signals are thus to be A(1),A(2) and A(3), and the selection signal is C(1). The second inkjet unit 432 is for receiving the voltage signal P(1), and the plural of address signals A(1),A(2) and A(3). When the selection signal C(1) is enabled such as at relative logic high state, the first inkjet unit 431 proceeds a heating performance in accordance with the voltage signal P(1) and the plural address signals A(1),A(2) and A(3). As for the selection signal C(1) is disabled such as at relative logic low condition, the second inkjet unit 432 proceeds a heating performance in accordance with the voltage signal P(1) and the plural address signals A(1),A(2) and A(3).

Figure 5A:
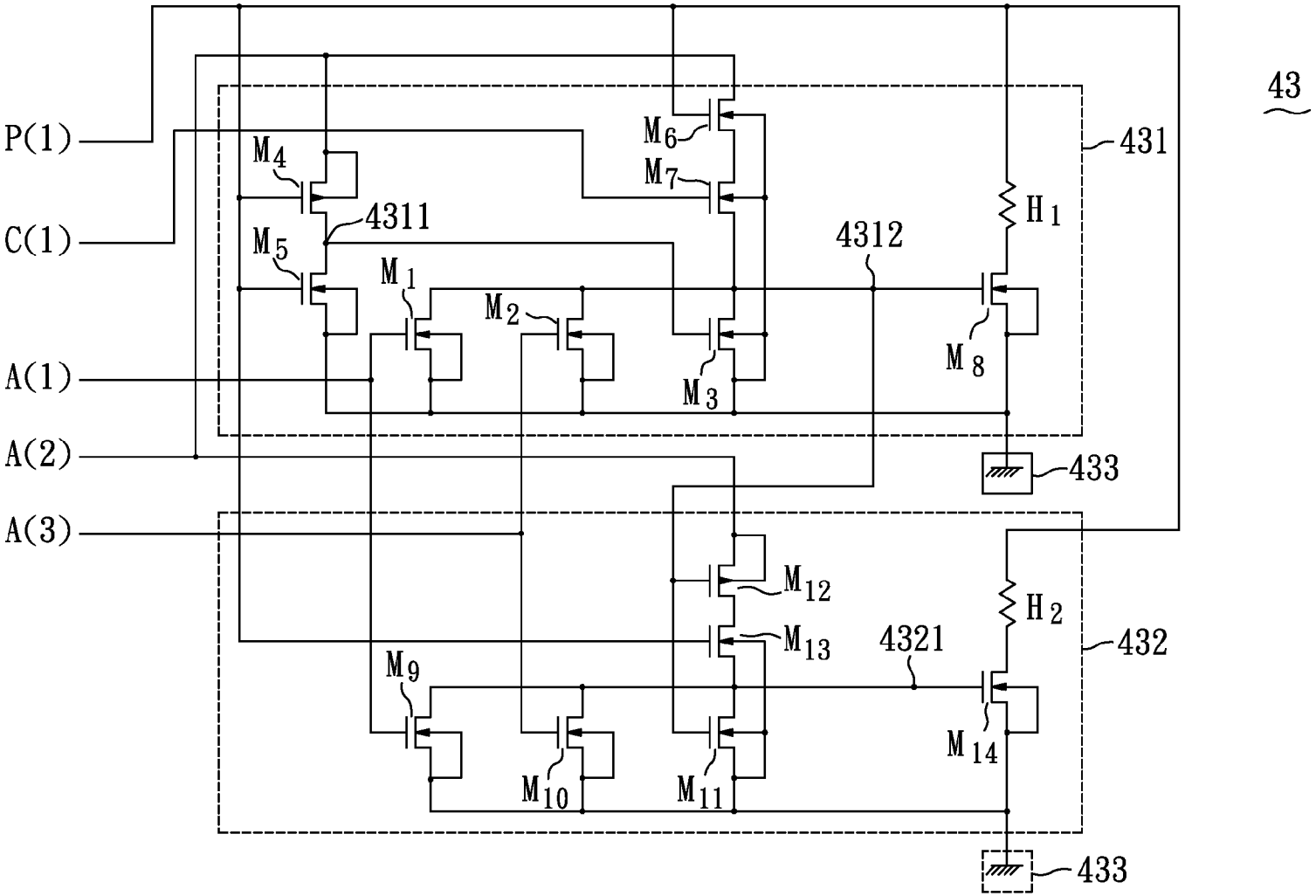
FIG. 5A is a schematic view illustrating the internal circuit structure of an inkjet unit assembly as shown in FIG. 4 of the present invention.

With reference to FIG. 5A, FIG. 5A is a schematic view illustrating the internal circuit structure of an inkjet unit assembly as shown in FIG. 4 of the present invention. As shown in FIG. 5A, the first inkjet unit 431 comprises a first switching element M1—an eighth switching element M8, and a first heating element H1, wherein the first switching element M1—the third switching element M3 and the fifth switching element M5—the eighth switching element M8 are preferably a N-MOS switching element, and the fourth switching element M4 is preferably a P-MOS switching element.

In the present embodiment, the base and source of the first switching element M1 are connected with each other and then connected to a ground terminal 433, the gate of the first switching element M1 is for receiving the first address signal A(1) of the plural of address signals. The base and source of the second switching element M2 are connected with each other and then connected to the ground terminal 433, the gate of the second switching element M2 is for receiving the third address signal A(3) of the plural of address signals. The base and source of the third switching element M3 are connected with each other and then connected to the ground terminal 433. The base and drain of the fourth switching element M4 are connected with each other and for receiving the second address signal A(2) of the plural address signals, and the gate thereof is for receiving the voltage signal P(1). The base and source of the fifth switching element M5 are connected with each other and then connected to the ground terminal 433, the gate thereof is for receiving the voltage signal P(1), moreover, the drain of the fifth switching element M5 and the source of the fourth switching element M4 are connected to a first common contact 4311, where the first common contact 4311 is connected with the gate of the third switching element M3.

In the present embodiment, an inverse element is formed by the combination of the fourth switching element M4 and the fifth switching element M5, the inverse element is such as an inverter, and the operation thereof is, when the voltage signal P(1) received by a input port (which is the connection terminal of the gate of the fourth switching element M4 and the gate of the fifth switching element M5) of the inverse element is at relative logic high (which implies V(P(1))=1), the fourth switching element M4 is turned off and the fifth switching element M5 is turned on. In the meantime, since the source of the fifth switching element M5 is connected to the ground terminal 433, thus, the electrical energy V(Ka) of an output port (which is the first common terminal 4311) is then suppressed to relative logic low, which means V(Ka)=0.

Inversely, when the voltage signal P(1) received by the input port of the inverse element is relative logic low (which implies V(P(1))=0), the fourth switching element M4 is turned on or off according to the second address signal A(2) received by the drain thereof. That is, if the second address signal A(2) is relatively logic high (which implies V(A(2))=1), the fourth switching element M4 is turned on and the fifth switching element M5 is turned off. Thereby, the electrical energy V(Ka) of the output port of the inverse element (which is the first common contact 4311) is then raised to relatively logic high, which means V(Ka)=1. With the above description, it is to know that the output port of the inverse element is at relatively logic low when the input port thereof is at relatively logic high. On the contrary, the output port of the inverse element is at relatively logic high when the input port thereof is at relatively logic low, and which is the operation principle of the inverse element. In addition, the electrical energy outputted by the inverse element is for controlling the seventh switching element M7 to be turned on or off in the present embodiment.

The base of the sixth switching element M6 is connected with the base of the third switching element M3, and the gate and drain of the sixth switching element M6 are for receiving the voltage signal P(1) and the second address signal A(2) respectively. The base of the seventh switching element M7 is connected with the base of the third switching element M3 as well, and the drain of the seventh switching element M7 is connected with the source of the sixth switching element M6. Additionally, the gate of the seventh switching element M7 is for receiving the selection signal C(1), such as the control signal for driving N-MOS switching element. The base and source of the eighth switching element M8 are connected with each other and then connected to the ground terminal 433, furthermore, the gate of the eighth switching element M8, the drain of the first switching element M1, the drain of the second switching element M2, the drain of the third switching element M3 and the source of the seventh switching element M7 are connected with a second common contact 4312. Moreover, a terminal of a first heating element H1 receives the voltage signal P(1) and the other terminal is connected with the drain of the eighth switching element M8.

In the present embodiment, the second inkjet unit 432 comprises a ninth switching element M9—a fourteenth switching element M14, and a second heating element H2. Where the ninth switching element M9—the eleventh switching element M11 and the thirteenth switching element M13—the fourteenth switching element M14 are preferably a N-MOS switching element, the twelfth switching element M12 is preferably a P-MOS switching element.

In the present embodiment, the base and source of the ninth switching element M9 are connected with each other and then connected to a ground terminal 433, the gate of the ninth switching element M9 is for receiving the first address signal A(1). The base and source of the tenth switching element M10 are connected with each other and then connected to a ground terminal 433, and the gate of the tenth switching element M10 is for receiving the third address signal A(3). The base and source of the eleventh switching element M11 are connected with each other and then connected to a ground terminal 433, and the gate of the eleventh switching element M11 is connected with the second common contact 4312 of the first inkjet unit 431.

The base and drain of the twelfth switching element M12 are connected with each other and for receiving the second address signal A(2), moreover, the gate of the twelfth switching element M12 is connected with the second common contact 4312 of the first inkjet unit 431. The base of the thirteenth switching element M13 is connected with the source of the twelfth switching element M12, and the gate of the thirteenth switching element M13 is for receiving the voltage signal P(1). The base and source of the fourteenth switching element M14 are connected with each other and then connected to a ground terminal 433, and the gate of the fourteenth switching element M14, the drain of the ninth switching element M9, the drain of the tenth switching element M10, the drain of the eleventh witching element M11 and the source of the thirteenth switching element M13 are connected with a third common contact 4321. Additionally, a terminal of a second heating element H2 receives the voltage signal P(1) and the other terminal is connected with the drain of the fourteenth switching element M14.

Figure 5B:
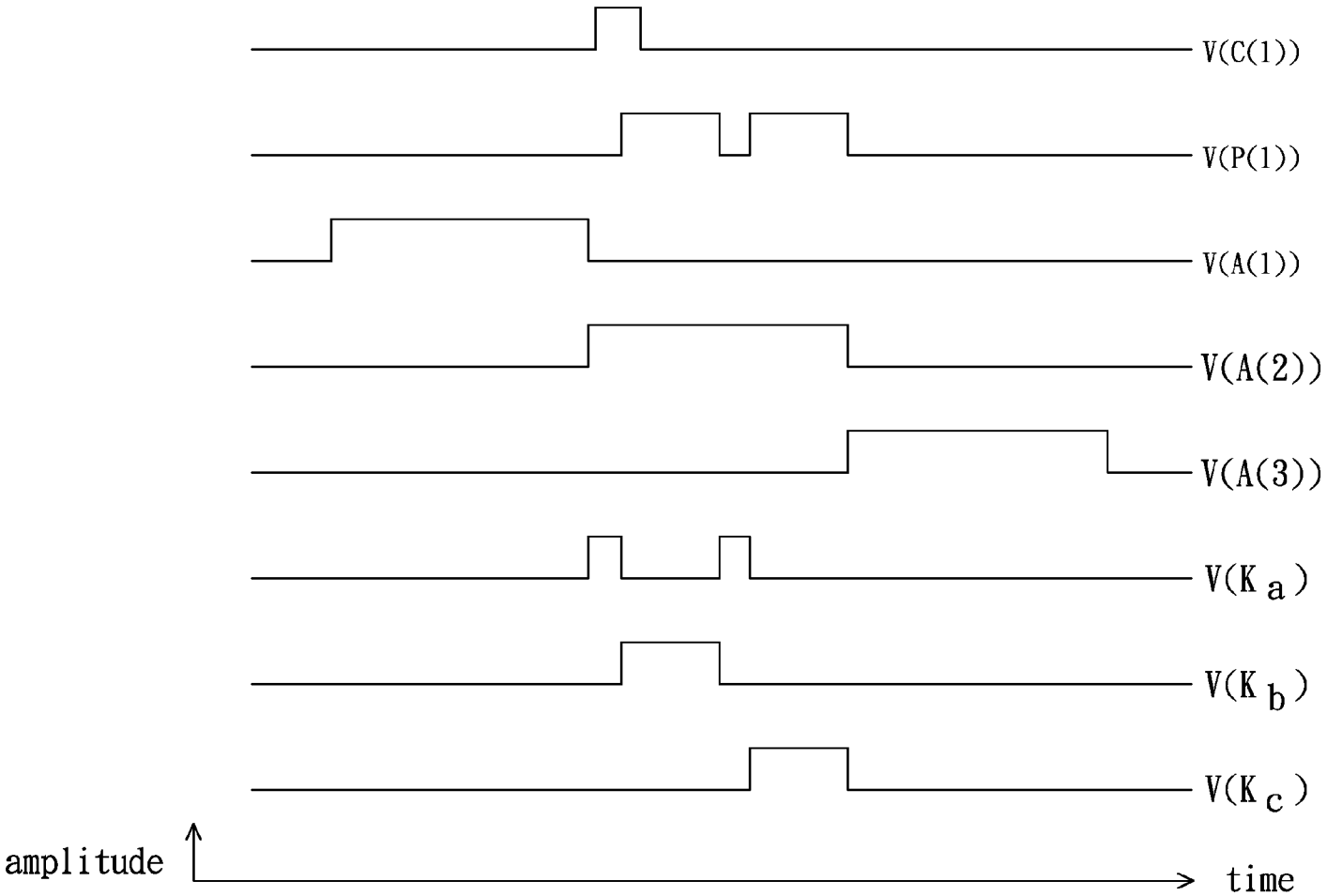
FIG. 5B is a schematic view illustrating the signal's forward timing to which the circuit of the inkjet unit assembly as shown in FIG. 5A is under operation.

With reference to FIG. 5B with FIG. 5A accompanied, where FIG. 5B is a schematic view illustrating the signal's forward timing to which the circuit of the inkjet unit assembly as shown in FIG. 5A is under operation. As shown in FIG. 5A and FIG. 5B, according to the concept of the present invention, when the voltage signal P(1), the selection signal C(1) and the second address signal A(2) is at relatively logic high simultaneously (which means V(P(1))=1,V(C(1))=1,V(A(2))=1), the sixth switching element M6 and the seventh switching element M7 is turned on. In the meantime, the electrical energy V(Kb) of the second common contact 4312 is raised to the potential of the second address signal A(2), furthermore, the second address signal A(2) passes through the sixth switching element M6 and the seventh switching element M7 in sequence and lets the eighth switching element M8 to be turned on. Additionally, the source of the eighth switching element M8 is connected with the ground terminal 433, this allows the voltage signal P(1) to provide electrical energy alternatively to the first heating element H1, for alternatively controlling the first heating element H1 to act the heating performance. For example, when the voltage signal P(1) is relatively logic high (which implies V(P(1))=1), the first heating element H1 is then driven by the voltage signal P(1) and lets the ink flowing passing thereon to be printed to a printing body via the corresponding nozzles (not shown in the figure), for achieving the printing procedure. The printing body can be such as a paper.

On the other side, since the second common contact 4312 and the second address signal A(2) are presently at relatively logic high, which makes the twelfth switching element M12 of the second inkjet unit 432 to be turned off, further leads the fourteenth switching element M14 to be turned off also. Therefore, the voltage signal P(1) is unable to provide electrical energy to the second heating element H2 and the second heating element H2 cannot be driven for heating thereby.

Moreover, when the selection signal C(1) turns to relatively logic low (which implies V(C(1))=0), the seventh switching element M7 and the eighth switching element M8 are turned off. In the meantime, the first heating element H1 stops the heating procedure due to the electrical energy provided to the first heating element H1 from the voltage signal P(1) is unable to be grounded.

Successively, when the voltage signal P(1) turns to relatively logic low (which implies V(P (1))=0), the electrical energy V(Ka) of the first common contact 4311 turns to relatively logic high after the voltage signal P(1) passes through the inverse element, which means V(Ka)=1. Otherwise, when one of the address signal which is to be the first address signal A(1) or the third address signal A(3) is relatively logic low (which implies V(A(1))=1 or V(A(3))=1), this makes the third switching element M3, the first switching element M1 or the second switching element M2 of the first inkjet unit 431 to be turned on, the electrical energy V(Kb) remained on the second common contact 4312 is thus guided to the ground terminal 433 via one of the third switching element M3, the first switching element M1 or the second switching element M2, further letting the electrical energy V(Kb) on the second common contact 4312 to be suppressed to 0V and letting the eighth switching element M8 to restore to initial state of pre-working.

In the present embodiment, when under the condition of the voltage signal P(1) turning to relatively logic high, the second address signal A(2) maintaining relatively logic high and the selection signal C(1) being relatively logic low (which means the second common contact 4312 is at relatively logic low as well), while the corresponding representation is V(P (1))=1, V(A(2))=1, V(C(1))=0 (which implies V(Kb)=0), in such a condition, the twelfth switching element M12 and thirteenth switching element M13 are turned on. In the meantime, the electrical energy V(Kc) of the third common contact 4321 rises to the potential of the second address signal A(2), moreover, the second address signal A(2) can pass through the twelfth switching element M12 and thirteenth switching element M13 in sequence and lets the fourteenth switching element M14 to be turned on. Additionally, the voltage signal P(1) provides electrical energy alternatively to the second heating element H2 due to the source of the fourteenth switching element M14 is grounded. Likewise, the voltage signal P(1) is for driving the second heating element H2 to heat and lets the ink flowing passing thereon to be printed to a printing body via the corresponding nozzles, for achieving the printing procedure successfully.

In the present embodiment, since the voltage signal P(1), the plural address signal A(1), A(2), and A(3) and the selection signal C(1) are outputted periodically, this permits the circuit to proceed the aforementioned operation periodically for the printing procedure. Therefore, when the first address signal A(1) or the third address signal A(3) turn to relatively logic high once again (which means V(A(1))=1 or V(A(3))=1), the allows one of the ninth switching element M9 or the tenth switching element M10 of the second inkjet unit 432 to be turned on. Otherwise, when the voltage signal P(1), the selection signal C(1), and the address signal A(2) turn to relative logic high and the electrical energy V(Kb) of the second common contact 4312 is relatively logic high as well, this allows the eleventh switching element M11 of the second inkjet unit 432 to be turned on. In the meantime, the electrical energy V(Kc) remained on the third common contact 4321 is thus guided to the ground terminal 433 via one of the ninth switching element M9, the tenth switching element M10 or the eleventh switching element M11, further letting the electrical energy V(Kb) on the third common contact 4321 to be suppressed to 0V and the fourteenth switching element M14 to be turned of. Furthermore, the second heating element H2 is unable to be driven for heating, by this, guarantee of only one of the first inkjet unit 431 or the second inkjet unit 432 is proceeding the heating procedure at one time is achieved.

With the above description, it is to know that the first inkjet unit 431 of the inkjet unit assembly 43 in accordance with the present embodiment discharges by one of the first switching element M1, the second switching element M2, or the third switching element M3. Likewise, the second inkjet unit 432 discharges by one of the ninth switching element M9, the tenth switching element M10, or the eleventh switching element M11. In addition, the inkjet unit assembly 43 can control the first heating element H1 or the second heating element H2 alternatively for heating with only a voltage signal P(1), plural address signal A(1), A(2), and A(3) and a selection signal C(1), and thus to achieve the printing procedure.

Figure 5C:
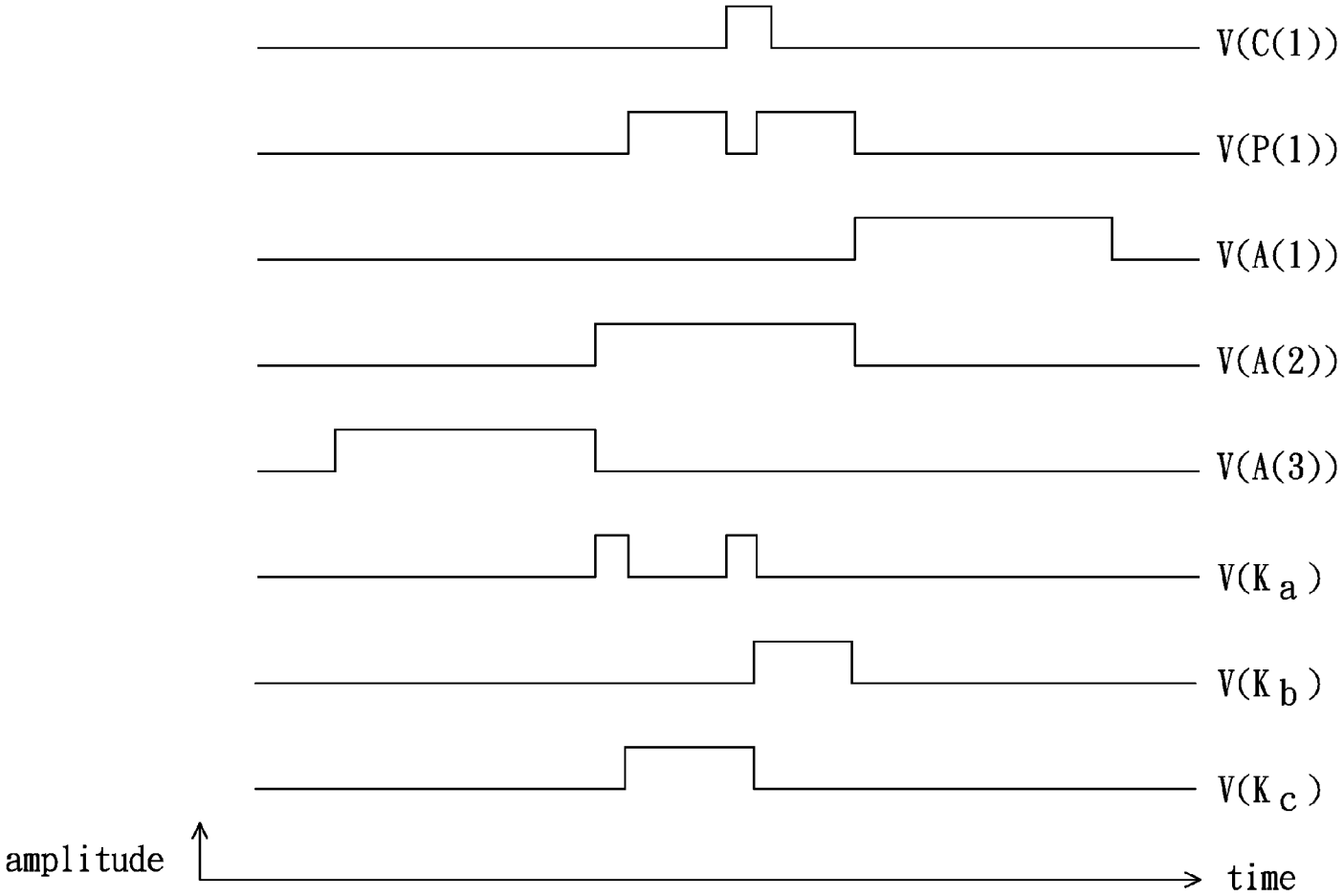
FIG. 5C is a schematic view illustrating the signal's reverse timing to which the circuit of the inkjet unit assembly as shown in FIG. 5A is under operation.

With reference to FIG. 5C with FIG. 5A accompanied, FIG. 5C is a schematic view illustrating the signal's reverse timing to which the circuit of the inkjet unit assembly as shown in FIG. 5A is under operation. As shown in FIG. 5A and FIG. 5C, the first inkjet unit 431 and the second inkjet unit 432 of the inkjet unit assembly 43 stand on the voltage signal P(1), the plural the address signal A(1), A(2), and A(3) and the selection signal C(1) for proceeding the printing procedure alternatively. The operation of FIG. 5C is similar with those of FIG. 5B and the relevant description is omitted thereby. However, in the present embodiment, the timing of the plural of address signal A(1), A(2), and A(3) and the selection signal C(1) are inverse to that as shown in FIG. 5B.

That is, when the inkjet unit assembly 43 is under forward printing condition, which means the status of the plural address signal A(1) to A(3) are relatively logic high in order, and the first address signal A(1) is outputted followed by the end of the third address signal A(3) to form a cycle signal transmission. By this, the first inkjet unit 431 proceeds the printing procedure first, and then second inkjet unit 432 proceeds the printing procedure subsequently. On the contrary, when the inkjet unit assembly 43 is under reverse printing condition, which means the status of the plural address signal A(3) to A(1) are relatively logic high in order, and the third address signal A(3) is outputted followed by the end of the first address signal A(1) to form a cycle signal transmission. By this, the second inkjet unit 432 proceeds the printing procedure, and then first inkjet unit 431 proceeds the printing procedure subsequently.

Figure 6A:
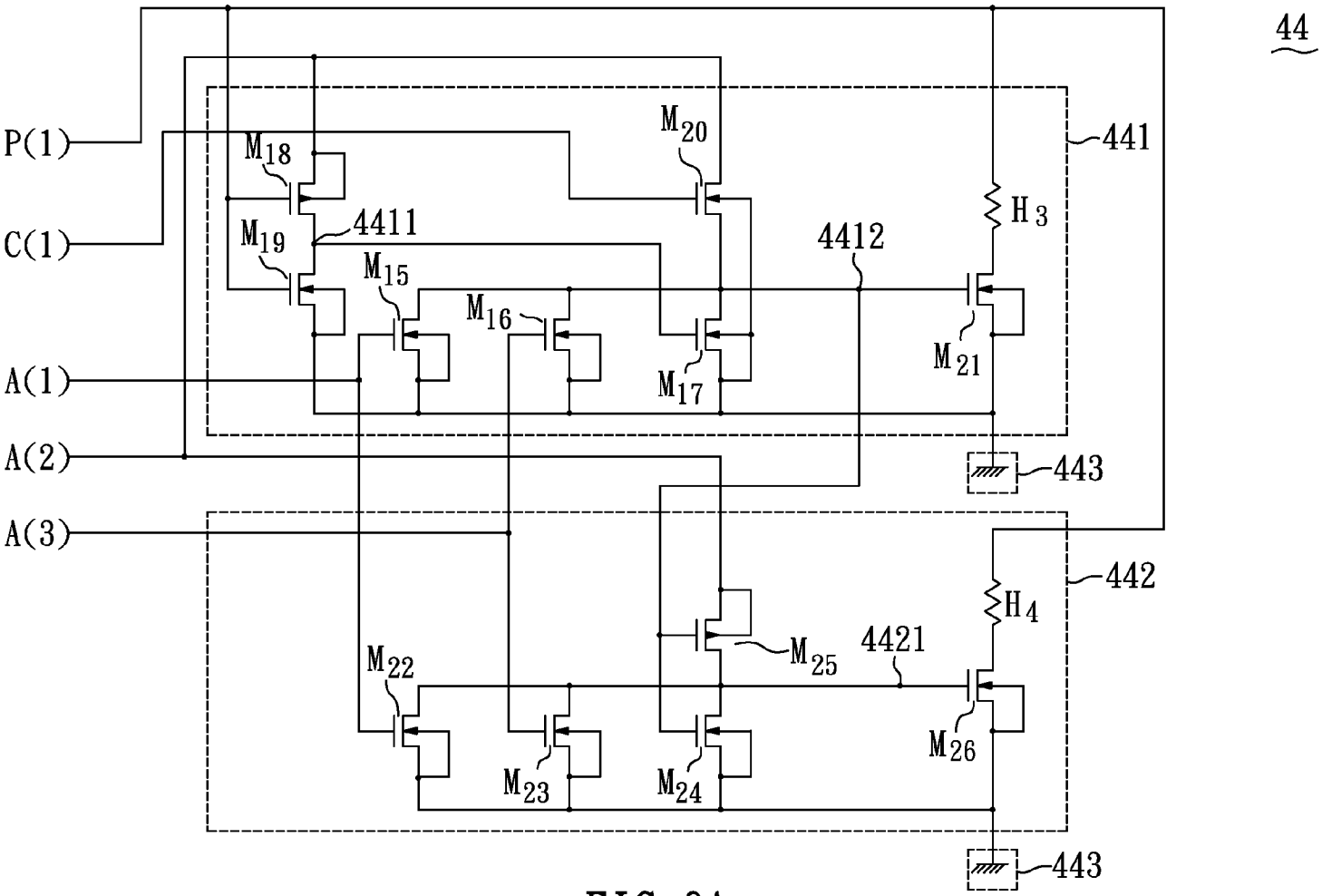
FIG. 6A is a schematic view illustrating the internal circuit structure of the other inkjet unit assembly as shown in FIG. 4 in accordance with the present invention.

With reference to FIG. 6A, FIG. 6A is a schematic view illustrating the internal circuit structure of the other inkjet unit assembly as shown in FIG. 4 in accordance with the present invention. As shown in FIG. 6A, the first inkjet unit 441 comprises a fifteenth switching element M15~a twenty-first switching element M21 in the present embodiment, and a third heating element H3, wherein the fifteen switching element M15~the seventeenth switching element M 17, the nineteenth switching element M19~the twenty-first switching element M21 are preferably a N-MOS switching element. Moreover, the eighteenth switching element M18 is preferably a P-MOS switching element.

In the present embodiment, the base and source of the fifteen switching element M15 are connected with each other and then connected to a ground terminal 443, the gate of the fifteen switching element M15 is for receiving the first address signal A(1) of the plural address signals. Additionally, the base and source of the sixteenth switching element M16 are connected with each other and then connected to a ground terminal 433, the gate of the sixteenth switching element M16 is for receiving the third address signal A(3) of the plural of address signals. The base and the drain of the eighteenth switching element M18 are connected with each other and for receiving the second address signal A(2) of the plural address signals, further the gate of the eighteenth switching element M18 is for receiving the voltage signal P(1). The base and source of the nineteenth switching element M19 are connected with each other and then connected to a ground terminal 443, the gate of the nineteenth switching element M19 is for receiving the voltage signal P(1), the drain of the nineteenth switching element M19 and the source of the eighteenth switching element M18 are both connected to a fourth common contact 4411. Moreover, the gate of the seventeenth switching element M17 is connected with the fourth common contact 4411.

In the present embodiment, an inverse element is formed by the combination of the eighteenth switching element M18 and the nineteenth switching element M19, the inverse element is such as an inverter. The operation thereof is similar to the inverse element formed by the fourth switching element M4 and the fifth switching element M5 as illustrated in FIG. 5A and the relevant description is thus omitted. However, in the present embodiment, the electrical energy outputted by the inverse element is for controlling the on and off of the seventeenth switching element M17.

The base of the twentieth switching element M20 is connected with base of the twentieth switching element M20, and the base and drain of the twentieth switching element M20 are for receiving the selection signal C(1) and the second address signal A(2) of the plural of address signal. The base and source of the twenty-first switching element M21 are connected with each other and then connected to a ground terminal 443. Additionally, the gate of the twenty-first switching element M21, the drain of the fifteenth switching element M15, the drain of the sixteenth switching element M16, the drain of the seventeenth switching element M17, and the source of the twentieth switching element M20 are all connected to a fifth common contact 4412. Besides, a terminal of the third heating element H3 is for receiving the voltage signal P(1) and the other terminal thereof is connected with the drain of the twenty-first switching element M21.

Figure 6B:
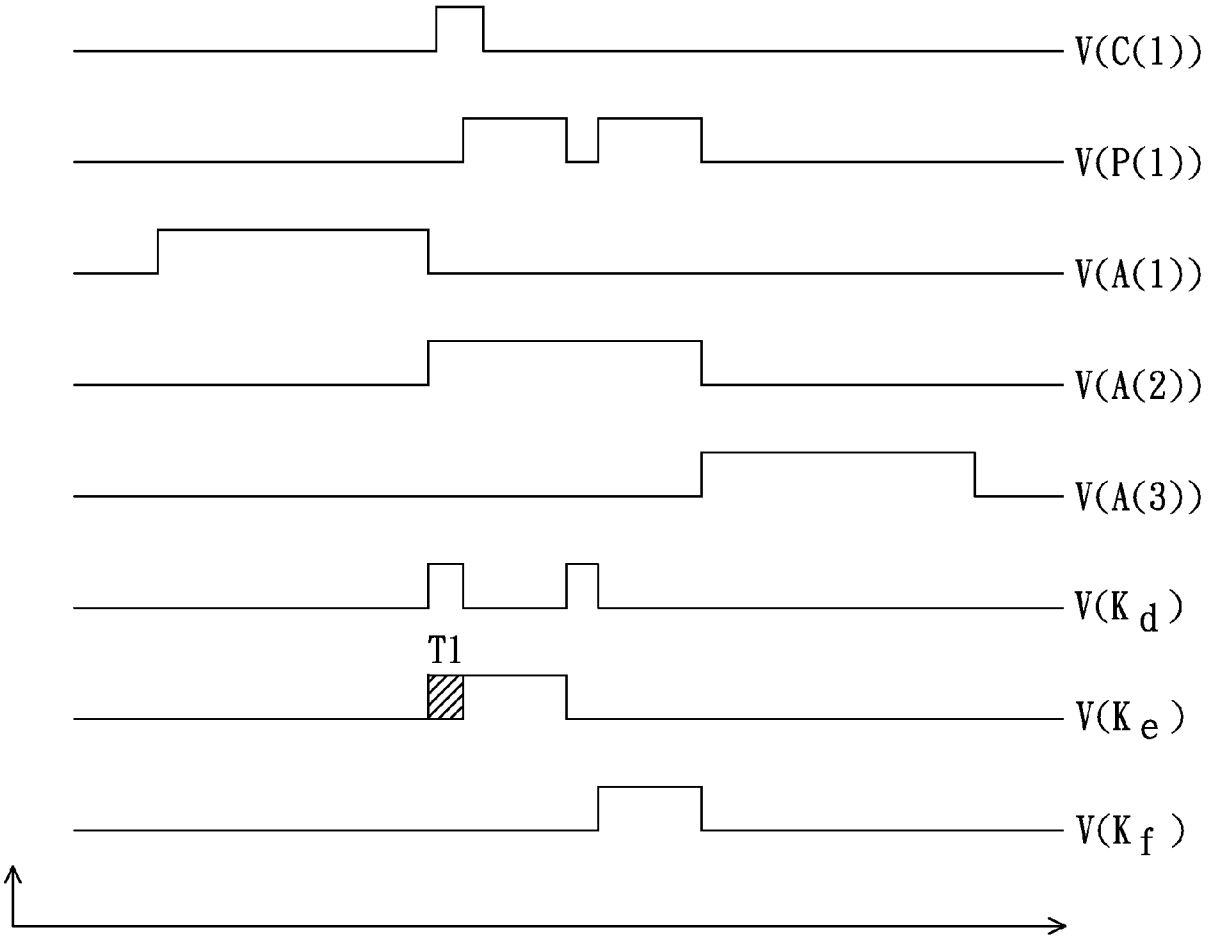
FIG. 6B is a schematic view illustrating the signal's forward timing to which the circuit of the inkjet unit assembly as shown in FIG. 6A is under operation.
Figure 6C:
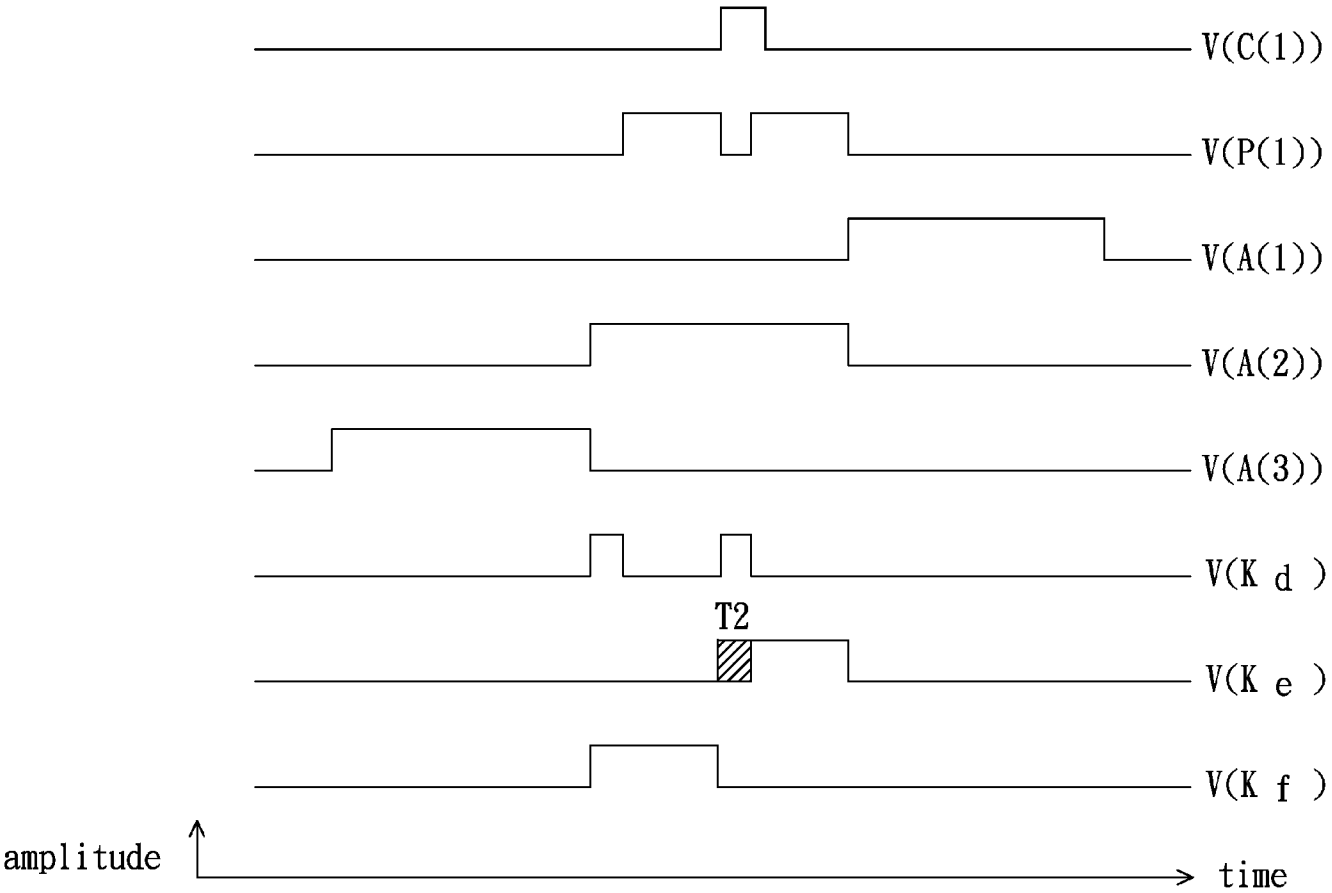
FIG. 6C is a schematic view illustrating the signal's reverse timing to which the circuit of the inkjet unit assembly as shown in FIG. 6A is under operation.

In the present embodiment, the voltage of the fifth common contact 4412 during the timing interval T1 in FIG. 6B and the timing interval T2 in FIG. 6C are acquired from voltage dividing of the internal resistor of the seventeenth switch element M17 and the internal resistor of the twentieth switch element M20, the internal resistance of the seventeenth switching element M17 is a resistor with high impedance. By this, when the seventeenth switching element M17 and the twentieth switching element M20 are turned on simultaneously, the electrical energy V(Ke) of the fifth common contact 4412 maintains at relative logic high, which means V(Ke)=1.

In the present embodiment, the second inkjet unit 442 comprises a twenty-second switching element M22 to a twenty-sixth switching element M26 and a fourth heating element H4, wherein the twenty-second switching element M22 to the twenty-fourth switching element M24 and the twenty-sixth switching element M26 are preferably a N-MOS switching element, the twenty-fifth switching element M25 is preferably a P-MOS switching element.

In the present embodiment, the base and the source of the twenty-second switching element M22 are connected with each other and then connected to a ground terminal 443, the gate of the twenty-second switching element M22 is for receiving the first address signal A(1). The base and the source of the twenty-third switching element M23 are connected with each other and then connected to a ground terminal 443, the gate of the twenty-third switching element M23 is for receiving the third address signal A(3). The base and the source of the twenty-fourth switching element M24 are connected with each other and then connected to a ground terminal 443, and the gate of the twenty-fourth switching element M24 is connected with the fifth common contact 4412 of the first inkjet unit 441.

The base and drain of the twenty-fifty switching element M25 are connected with each other for receiving the second address signal A(2), and the gate of the twenty-fifty switching element M25 is connected with the fifth common contact 4412 of the first inkjet unit 441. The base and the source of the twenty-sixth switching element M26 are connected with each other and then connected to a ground terminal 443, and the gate of the twenty-sixth switching element M26, the drain of the twenty-second switching element M22, the drain of the twenty-third switching element M23, the drain of the twenty-fourth switching element M24 and the source of the twenty-fifty switching element M25 are connected with a sixth common contact 4421. Additionally, a terminal of the fourth heating element H4 is for receiving the voltage signal P(1) and the other terminal thereof is connected with the drain of the twenty-sixty switching element M26.

With reference to FIG. 6B with FIG. 6A accompanied, FIG. 6B is a schematic view illustrating the signal's forward timing to which the circuit of the inkjet unit assembly as shown in FIG. 6A is under operation. As shown in FIG. 6A and FIG. 6B, according to the concept of the present invention, when the selection signal C(1) and the second address signal A(2) is at relative logic high simultaneously (which means V(C(1))=1·V(A(2))=1), the twentieth switching element M20 is opened. In the meantime, the electrical energy V(Ke) of the fifth common contact 4412 is raised to the potential of the second address signal A(2), furthermore, the second address signal A(2) passes through twentieth switching element M20 and lets the twenty-first switching element M21 to be turned on. Additionally, due to source of the twenty-first switching element M21 is connected with the ground terminal 443, this allows the voltage signal P(1) to provide electrical energy alternatively to the third heating element H3 for alternatively controlling the third heating element H3 to perform the heating procedure, and lets the ink flowing passing thereon to be printed to a printing body via the corresponding nozzles, for achieving the printing procedure. The printing body can be such as a paper.

On the other side, since the fifth common contact 4412 and the second address signal A(2) are presently at relatively logic high, which makes the twenty-fifth switching element M25 of the second inkjet unit 442 to be cutoff, further leads the twenty-sixth switching element M26 to be turned off also. Therefore, the voltage signal P(1) is unable to provide electrical energy to the fourth heating element H4 and the fourth heating element H4 cannot be driven for heating thereby.

Moreover, when the selection signal C(1) turns to relatively logic low (which implies V(C(1))=0), the twentieth switching element M20 and the twenty-first switching element M21 are turned off. In the meantime, the third heating element H3 stops the heating procedure due to the electrical energy provided to the third heating element H3 from the voltage signal P(1) is unable to be grounded.

Successively, when the voltage signal P(1) turns to relatively logic low (which implies V(P (1))=0), the electrical energy V(Kd) of the fourth common contact 4411 turns to relative logic high accordingly after the voltage signal P(1) passes through the inverse element, which means V(Kd)=1. Otherwise, when one of the address signal which is to be the first address signal A(1) or the third address signal A(3) is relatively logic low (which implies V(A(1))=1 or V(A(3))=1), this makes the seventeenth switching element M17 the fifteenth switching element M15 or the sixteenth switching element M16 to be opened, the electrical energy V(Ke) remained on the fifth common contact 4412 is thus guided to the ground terminal 443 via one of the seventeenth switching element M17, the fifteenth switching element M15 or the sixteenth switching element M16, further letting the electrical energy V(Ke) on the fifth common contact 4412 to be suppressed to 0V and to let the twenty-first switching element M21 to restore to initial state of pre-working.

In the present embodiment, when under the condition of the second address signal A(2) is maintaining at relative logic high, and the selection signal C(1) is at relatively logic low (which means the fifth common contact 4412 is at relatively logic low as well), while the corresponding representation is V(A(2))=1,V(C(1))=0 (which implies V(Ke)=0), in such a condition, the twenty-fifth switching element M25 is opened. In the meantime, the electrical energy V(Kf) of the sixth common contact 4421 rises to the potential of the second address signal A(2), moreover, the second address signal A(2) can pass through the twenty-fifth switching element M25 and lets the twenty-sixth switching element M26 to be turned on. Additionally, the voltage signal P(1) provides electrical energy alternatively to the fourth heating element H4 due to the source of the twenty-sixth switching element M26 is grounded. Likewise, the voltage signal P(1) is for driving the fourth heating element H4 to heat up and lets the ink flowing passing thereon to be printed to a printing body via the corresponding nozzles, for achieving the printing procedure successfully.

Likewise, in the present embodiment, since the plural address signal A(1), A(2), and A(3) and the selection signal C(1) are outputted periodically, this permits the circuit to proceed the above operation periodically for the printing procedure. Therefore, when the first address signal A(1) or the third address signal A(3) turn to relatively logic high once again (which means V(A(1))=1 or V(A(3))=1), the allows one of the twenty-second switching element M22 or the twenty-third switching element M23 of the second inkjet unit 442 to be turned on. Otherwise, when the selection signal C(1) and the address signal A(2) turn to relatively logic high and the electrical energy V(Ke) of the fifth common contact 4412 is relatively logic high as well, this allows the twenty-fourth switching element M24 of the second inkjet unit 442 to be opened. In the meantime, the electrical energy V(Kf) remained on the sixth common contact 4421 is thus guided to the ground terminal 443 via one of the twenty-second switching element M22, the twenty-third switching element M23 or the twenty-fourth switching element M24, further letting the electrical energy V(Kf) on the sixth common contact 4421 to be suppressed to 0V and the twenty-sixth switching element M26 to be turned off. Furthermore, the fourth heating element H4 is unable to be driven for heating, by this, guarantee of only one of the first inkjet unit 441 or the second inkjet unit 442 is proceeding the heating procedure at one time is achieved.

With the above description, it is to know that the first inkjet unit 441 of the inkjet unit assembly 44 in accordance with the present embodiment discharges by one of the fifteenth switching element M15, the sixteenth switching element M16 or the seventeenth switching element M17. Likewise, the second inkjet unit 442 discharges by one of the twenty-second switching element M22, the twenty-third switching element M23 or the twenty-fourth switching element M24. In addition, the inkjet unit assembly 44 can control the third heating element H3 or the fourth heating element H4 alternatively for heating with only a voltage signal P(1), plural of address signal A(1), A(2), and A(3) and a selection signal C(1), and thus to achieve the printing procedure.

With reference to FIG. 6C with FIG. 6A accompanied, FIG. 6C is a schematic view illustrating the signal's reverse timing to which the circuit of the inkjet unit assembly as shown in FIG. 6A is under operation. As shown in FIG. 6A and FIG. 6C, the first inkjet unit 441 and the second inkjet unit 442 of the inkjet unit assembly 44 stands on the voltage signal P(1), the plural of address signal A(1), A(2), and A(3) and the selection signal C(1) for proceeding the printing procedure alternatively. The operation of FIG. 6C is similar with those of FIG. 6B and the relevant description is omitted thereby. However, in the present embodiment, the timing of the plural address signal A(1), A(2), and A(3) and the selection signal C(1) are inverse to that as shown in FIG. 6B. That is, when the inkjet unit assembly 44 is under forward printing condition, the first inkjet unit 441 proceed the printing procedure first, and then second inkjet unit 442 proceed the printing procedure subsequently. On the contrary, when the inkjet unit assembly 44 is under reverse printing condition, the second inkjet unit 442 proceed the printing procedure, and then first inkjet unit 441 proceed the printing procedure subsequently.

Figure 7A:
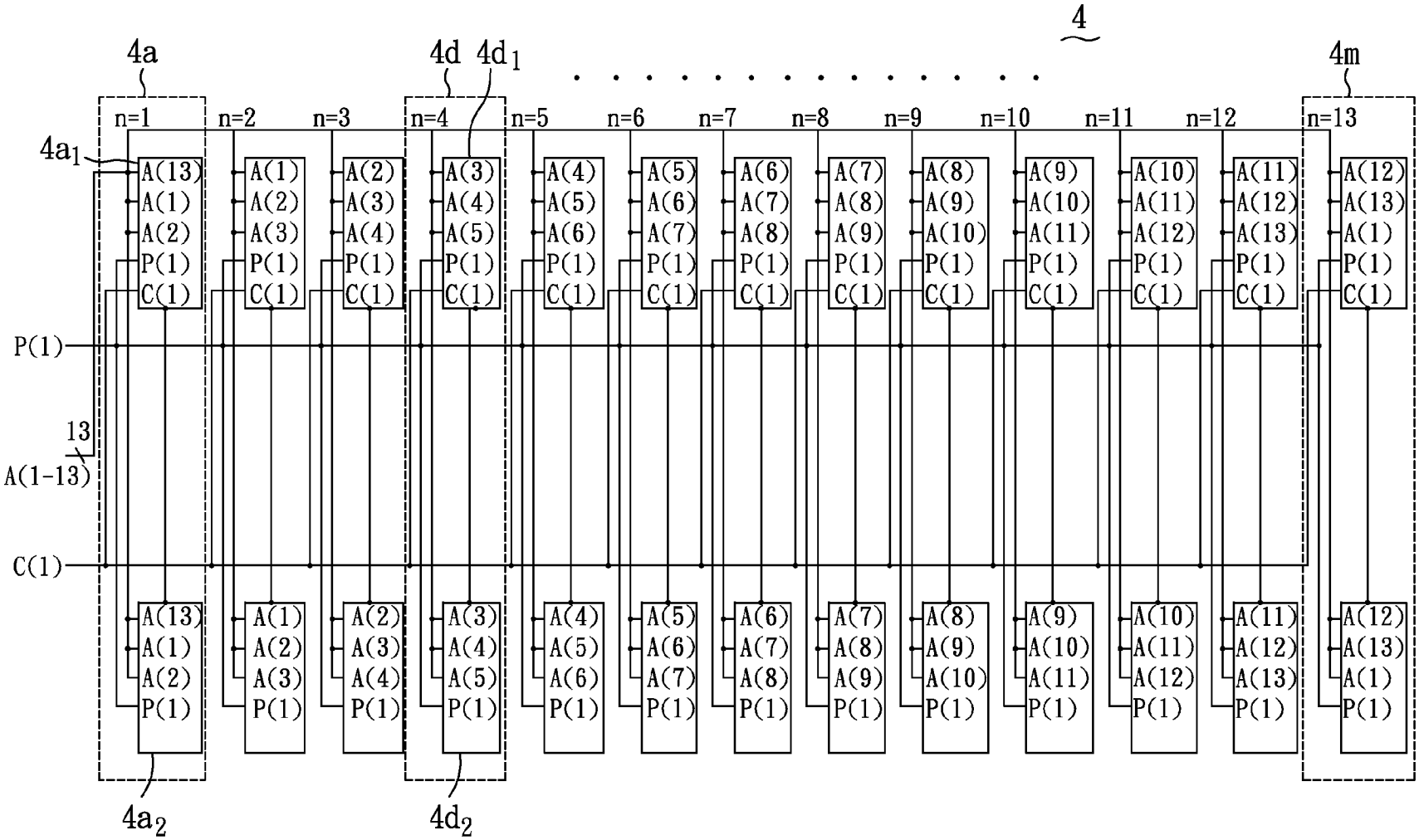
FIG. 7A is a schematic view illustrating the inkjet array block in accordance with a preferred embodiment of the present invention.
Figure 7B:
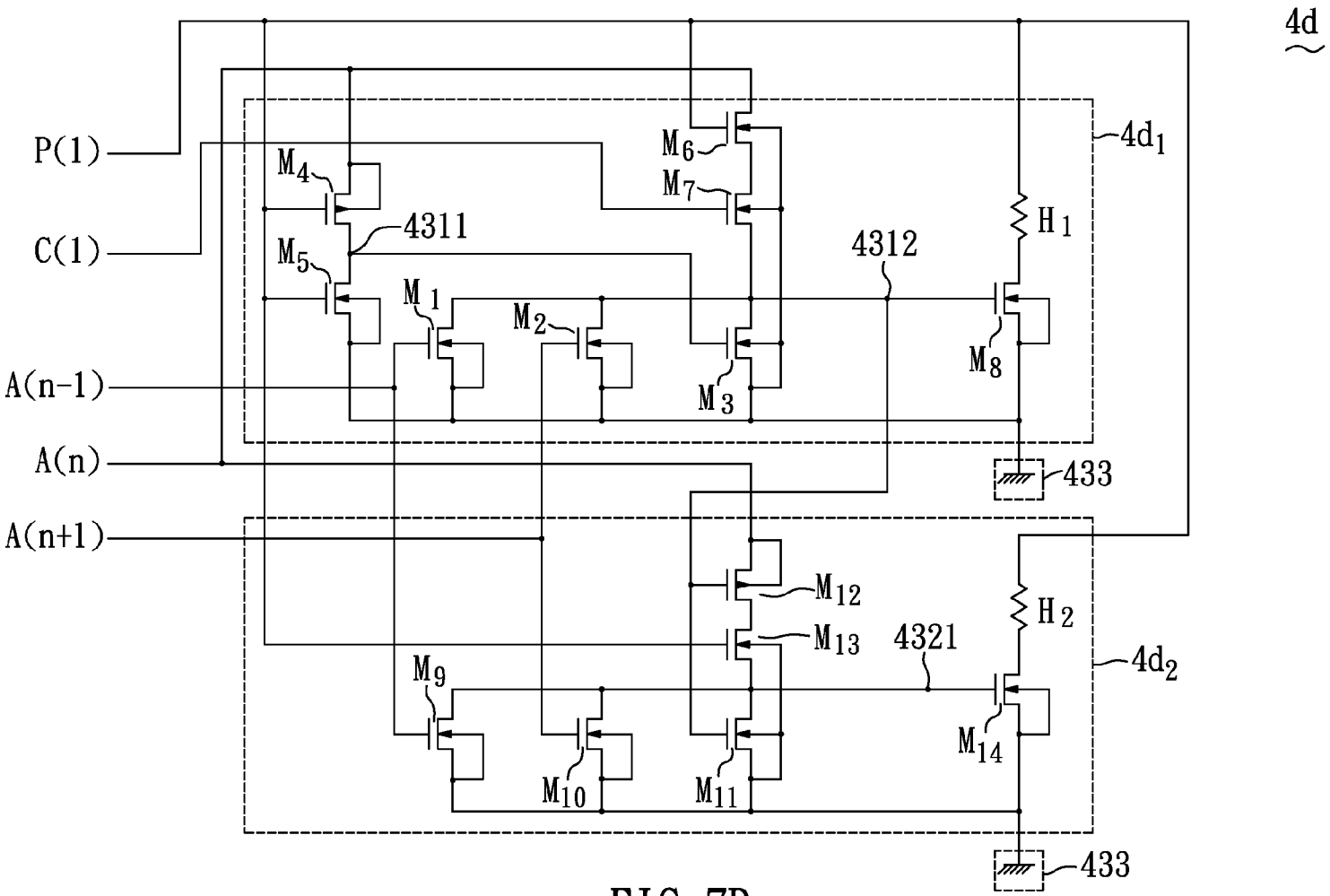
FIG. 7B is a schematic view illustrating the extension circuit structure of FIG. 5A.
Figure 7C:
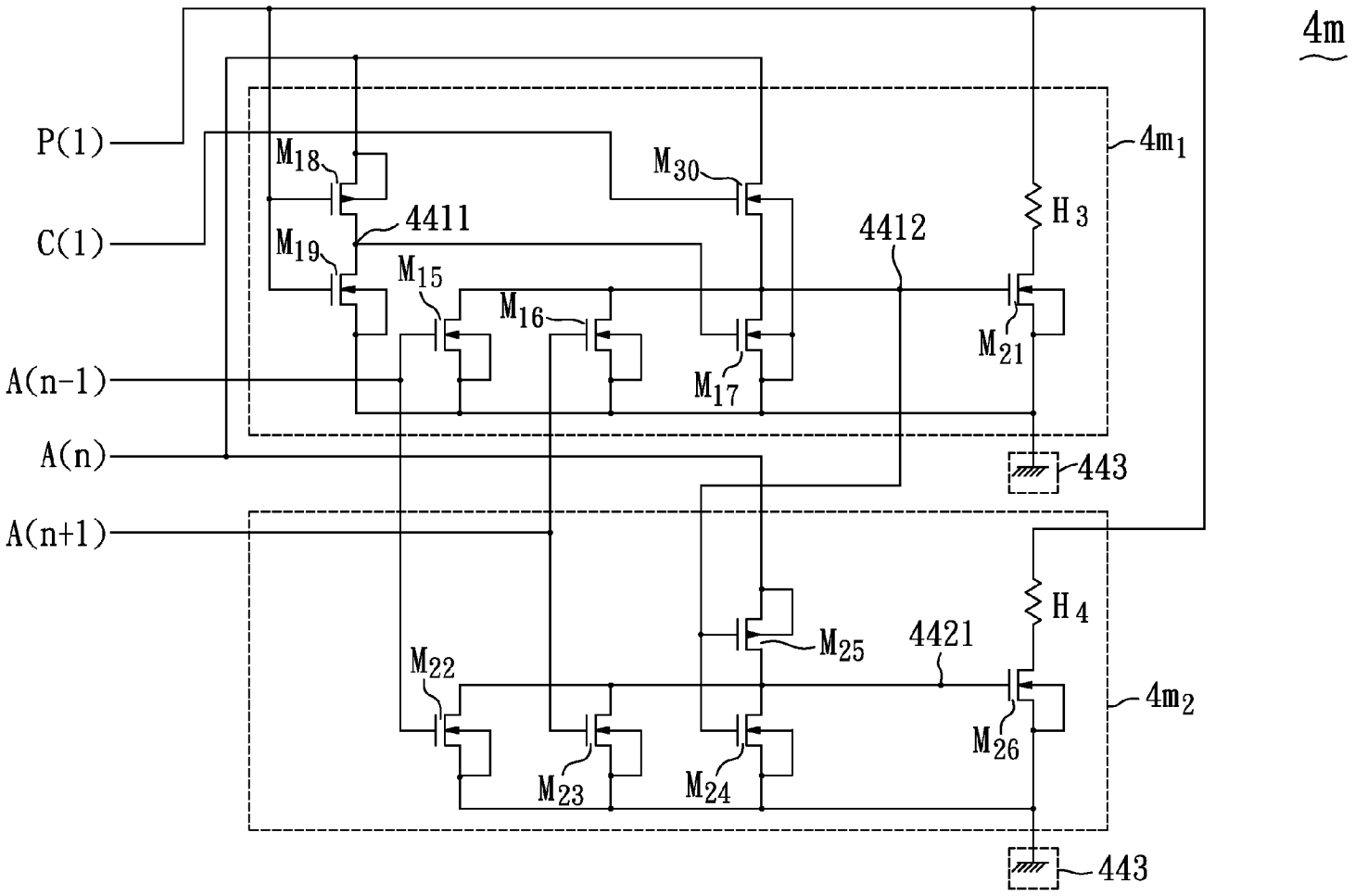
FIG. 7C is a schematic view illustrating the extension circuit structure of FIG. 6A.

With reference to FIGS. 7A, 7B, and 7C, FIG. 7A is a schematic view illustrating the inkjet array block in accordance with a preferred embodiment of the present invention; FIG. 7B is a schematic view illustrating the extension circuit structure of FIG. 5A; and FIG. 7C is a schematic view illustrating the extension circuit structure of FIG. 6A. As shown in FIGS. 7A, 7B, and 7C, inkjet array 4 comprises plural of inkjet unit assembly, such as a first inkjet unit assembly 4*a*~a thirteenth inkjet assembly 4*m*. The internal circuit structure of each inkjet unit assembly 4*a*-4*m* can be as the circuit structure as illustrated in FIG. 7B and FIG. 7C, but not be limited. Additionally, the connection and operation of the circuit are the same as those of FIG. 5A and FIG. 6A and the relative description is thus omitted.

However, in the present embodiment, each inkjet unit assembly 4*a*-4*m* receives the voltage signal P(1), and the first address signal A(1)~the thirteenth address signal A(13) respectively and correspondingly. Moreover, each first inkjet unit 4*a*1~4*m*1 receives the selection signal C(1) correspondingly for controlling the plural of the inkjet unit assembly 4*a*~4*m* to heat respectively. In the present embodiment, inkjet array 4 is disposed on an inkjet chip (not shown in the figure). And for some other embodiments, plural of inkjet arrays 4 can be disposed on the inkjet chip for advancing the printing resolution and printing speed in inkjet printing technique.

The inkjet unit assembly as shown in FIG. 7B is one of the plural inkjet unit assembly 4*a*-4*m* of inkjet array 4. For example, when the timing n equals to 4, and which indicates to the fourth inkjet unit assembly 4*d*. The fourth inkjet unit assembly 4*d* comprises a first inkjet unit 4*d*1 and a second inkjet unit 4*d*2, and the first inkjet unit 4*d*1 comprises a first switching element M1~a eighth switching element M8, and a first heating element H1. While the second inkjet unit 4*d*2 comprises a ninth switching element M9~a fourteenth switching element M14, and a second heating element H2, the connection and operation of the circuit are the same as those of FIG. 5A and the relevant description is thus omitted. Nevertheless, in the present embodiment, the timing n equals to 4 and the first inkjet unit 4*d*1 receives the voltage signal P(1), the plural of the address signals A(n−1),A(n) and A(n+1), and the selection signal C(1). Where the address signals are the third address signal A(3), the fourth address signal A(4), and the fifth address signal A(5). The second inkjet unit 4*d*2 receives the voltage signal P(1) and the plural address signals A(3),A(4) and A(5) correspondingly. Additionally, when the selection signal C(1) is enabled such as under status of relatively logic high, the first inkjet unit 4*d*1 perform a heating procedure with regard to the voltage signal P(1) and the plural address signals A(3),A(4) and A(5).

Likewise, the inkjet unit assembly as shown in FIG. 7C is one of the plural inkjet unit assembly 4*a*-4*m* of inkjet array 4. For example, when the timing n equals to 13, and which indicates to the thirteenth inkjet unit assembly 4*m*. The thirteenth inkjet unit assembly 4*m* comprises a first inkjet unit 4*m*1 and a second inkjet unit 4*m*2, and the first inkjet unit 4*m*1 comprises a fifteenth switching element M12~a twenty-first switching element M21, and a third heating element H3. While the second inkjet unit 4*m*2 comprises a twenty-second switching element M22~a twenty-sixth switching element M26, and a fourth heating element H4, the connection and operation of the circuit are the same as those of FIG. 6A and the relevant description is thus omitted. Nevertheless, in the present embodiment, the timing n equals to 13 and the first inkjet unit 4*m*1 receives the voltage signal P(1), the plural the address signals A(n−1),A(n) and A(n+1), and the selection signal C(1). The address signals are the twelfth address signal A(12), the thirteenth address signal A(13), and the first address signal A(1). The second inkjet unit 4*m*2 receives the voltage signal P(1) and the plural address signals A(12),A(13) and A(1) correspondingly. Additionally, when the selection signal C(1) is enabled, the first inkjet unit 4*m*1 acts a heating procedure with regard to the voltage signal P(1) and the plural of address signals A(12),A(13) and A(1). On the contrary, when the selection signal C(1) is disabled, the second inkjet unit 4*m*2 acts a heating procedure with regard to the voltage signal P(1) and the plural address signals A(12),A(13) and A(1).

In some other embodiments, the inkjet array 4 can receives N address signals A, where N is an integer. For example, N is, but not limited to, 16. Namely, the inkjet array 4 can receives 16 address signals A and the timing n is between 1 and 16. Therefore, when n equals to 1, the plural address signals are A(n−1)=16,A(n)=1 and A(n+1)=2, when n equals to 16, the plural address signals are A(n−1)=15,A(n)=16 and A(n+1)=1. By way of this, each inkjet unit assembly of the inkjet array 4 is controlled for heating procedure.

Figure 8A:
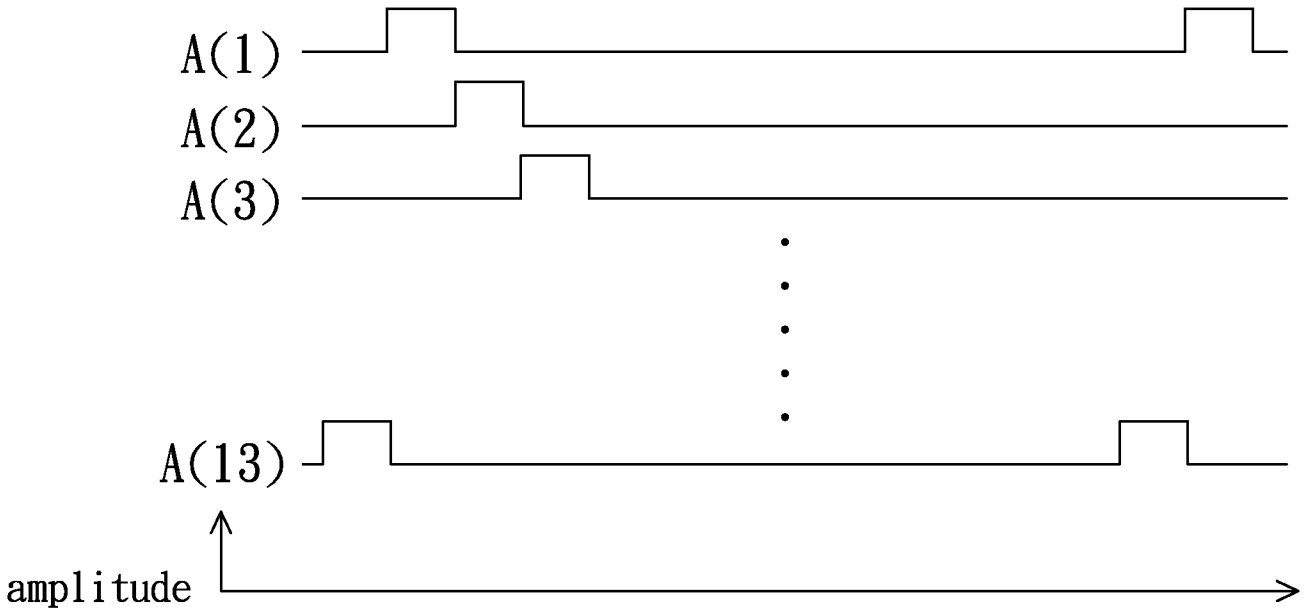
FIG. 8A is a timing view illustrating the address signal at a first printing direction in accordance with the embodiment of the present invention.
Figure 8B:
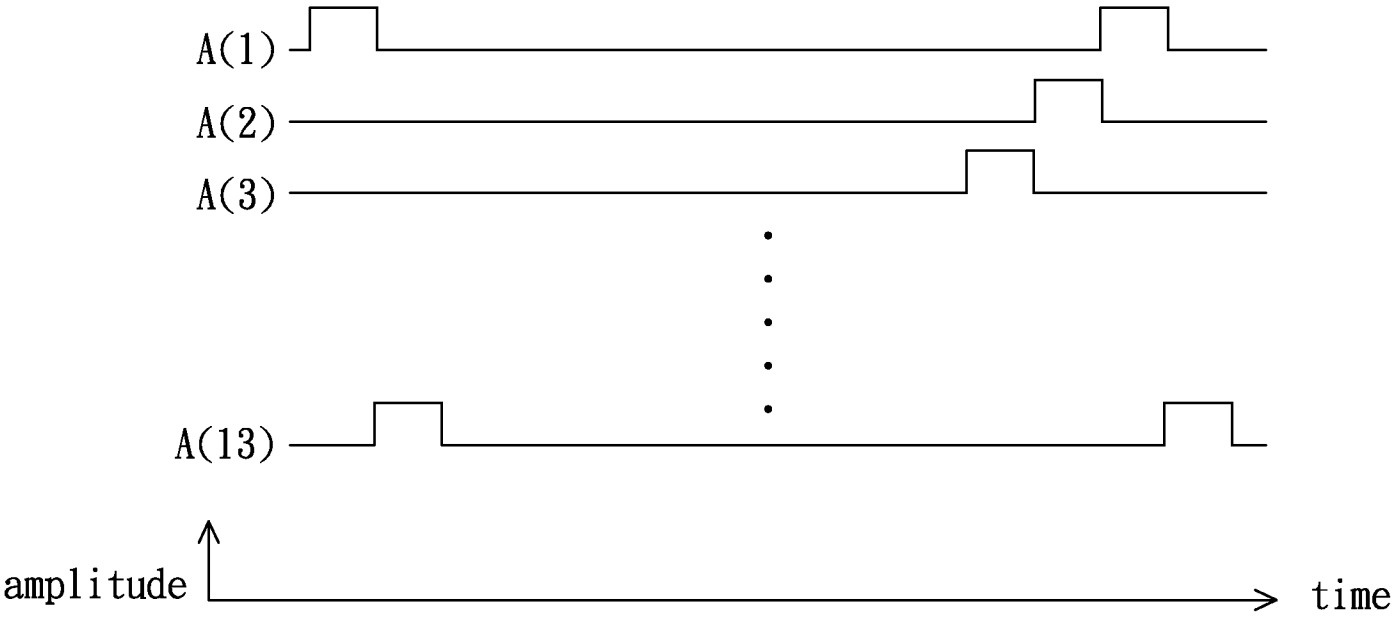
FIG. 8B is a timing view illustrating the address signal at a second printing direction in accordance with the embodiment of the present invention.

With reference to FIG. 8A and FIG. 8B, FIG. 8A is a timing view illustrating the address signal at a first printing direction in accordance with the embodiment of the present invention; and FIG. 8B is a timing view illustrating the address signal at a second printing direction in accordance with the embodiment of the present invention. As shown in FIG. 8A and FIG. 8B, the first printing direction, for example, forwardly printing, which implies the plural address signals are at relatively logic high and are outputted by A(1)~A(13) in order and thus to form a cycle signal transmission. Inversely, the second printing direction, for example, reversely printing, which implies the plural address signals are at relative logic high and are outputted by A(13)~A(1) in order, moreover, the thirteenth address signal A(13) is outputted followed by the end of the first address signal A(1) to form a cycle signal transmission. By this, bi-directional printing is able to be done by the inkjet printhead.

Moreover, a previous address signal A(n−1) and a later address signal A(n+1) are employed in the bi-directional printing mechanism for achieving discharging effectively, and lets the switching element being driven to restore to initial state of pre-working.

More heater being disposed on a chip via interlaced arrangement to employ the space of an inkjet printhead further to decrease the cost and to increase the printing speed is not only achieved by inkjet printhead of the present invention, but also achieve the reduction of the wiring region on an inkjet chip via address control method of reducing the interior chip in the inkjet chip, which allows the wiring region of the inkjet chip in a single-color inkjet printhead to merely occupy 63% to 80% of the total area of the inkjet chip. This achieves decreasing the size of the inkjet printhead correspondingly and hence is cost-effective on manufacturing the same.

Although the present invention has been explained in relation to its preferred embodiment, it is to be understood that many other possible modifications and variations can be made without departing from the spirit and scope of the invention as hereinafter claimed.

What is claimed is:

1. An inkjet printhead structure adapted for an ink cartridge that includes one single ink-supplying tank, comprising:

a nozzle plate having a plurality of nozzles; and an inkjet chip for controlling ink jetting and having a total area region having a length and a width, the total area region including:

a non-wiring region for installing one single ink-supplying flow channel, the non-wiring region being only the area of the ink-supplying flow channel; and a wiring region for installing an internal circuit including a plurality inkjet unit assembly, each inkjet unit of the inkjet unit assembly including a heater installed correspondingly to the nozzle;

wherein an area of the wiring region of the inkjet chip is or less than 82% of a total area of the inkjet chip.

2. The inkjet printhead structure as claimed in claim 1, wherein the area of the wiring region of the inkjet chip is 63% to 80% of the total area of the inkjet chip.

3. The inkjet printhead structure as claimed in claim 1, wherein the length/width ratio is between 11 and 20.

4. The inkjet printhead structure as claimed in claim 1, wherein the width of the inkjet chip is between 1.27 and 2.31 millimeter.

5. The inkjet printhead structure as claimed in claim 1, wherein the length of the inkjet chip is 25.4 millimeter.

6. The inkjet printhead structure as claimed in claim 1, wherein a maximum area of the inkjet chip is 58.67 $m^2$.

7. The inkjet printhead structure as claimed in claim 1, wherein the inkjet chip includes at least 750 heaters.

8. The inkjet printhead structure as claimed in claim 1, wherein the number of the heaters is 13 to 23 per square millimeters, and the heaters are arranged in at least one axis.

9. An inkjet printhead structure adapted for an ink cartridge that includes one single ink-supplying tank, comprising:

a nozzle plate having a plurality of nozzles; and an inkjet chip for controlling ink jetting and having a total area region having a length and a width, the total area region including:

a non-wiring region for installing one single ink-supplying flow channel, the non-wiring region being only the area of the ink-supplying flow channel; and a wiring region for installing an internal circuit including a plurality inkjet unit assembly, each inkjet unit of the inkjet unit assembly including a heater installed correspondingly to the nozzle, each inkjet unit assembly comprising:

a first inkjet unit for receiving a voltage signal, a plurality of address signal and a selection signal; and a second inkjet unit for receiving the voltage signal and the plurality of address signal;

wherein the first inkjet unit makes the heater to act a heating performance when the selection signal is enabled in accordance with the voltage signal and the plurality of address signal, and the second inkjet unit makes the heater act a heating performance when the selection signal is disabled in accordance with the voltage signal and the plurality of address signal, an area of the wiring region of the inkjet chip occupies under 82% of a total area of the inkjet chip.

10. The inkjet printhead structure as claimed in claim 9, wherein the area of the wiring region of the inkjet chip is 63% to 80% of the total area of the inkjet chip.

* * * * *